US008141707B2

(12) United States Patent
Robbins et al.

(10) Patent No.: US 8,141,707 B2
(45) Date of Patent: Mar. 27, 2012

(54) RECONFIGURABLE PACKAGE FOR CONFECTIONERY PRODUCTS

(75) Inventors: James W. Robbins, Chicago, IL (US); Ryan A. Bailey, Richmond, VA (US)

(73) Assignee: Wm. Wrigley Jr. Company, Chicago, IL (US)

( * ) Notice: Subject to any disclaimer, the term of this patent is extended or adjusted under 35 U.S.C. 154(b) by 0 days.

(21) Appl. No.: 12/937,692

(22) PCT Filed: Apr. 14, 2009

(86) PCT No.: PCT/US2009/002296

§ 371 (c)(1),
(2), (4) Date: Feb. 8, 2011

(87) PCT Pub. No.: WO2009/151504

PCT Pub. Date: Dec. 17, 2009

(65) Prior Publication Data

US 2011/0162997 A1 Jul. 7, 2011

Related U.S. Application Data

(60) Provisional application No. 61/124,054, filed on Apr. 14, 2008.

(51) Int. Cl.
*B65D 75/00* (2006.01)

(52) U.S. Cl. ..... 206/447; 229/120.011

(58) Field of Classification Search ..... 229/120.011, 229/120.012; 206/447

See application file for complete search history.

(56) References Cited

U.S. PATENT DOCUMENTS 3,135,457 A * 6/1964 Risucci ..... 229/120.011
4,377,237 A 3/1983 Pawlowski
4,618,090 A 10/1986 Cortellucci
4,793,487 A * 12/1988 Bentsen et al. ..... 206/451
4,793,494 A * 12/1988 Gordon, Jr. ..... 229/120.011
4,932,534 A * 6/1990 Focke et al. ..... 229/120.011
5,125,211 A 6/1992 O'Brien
5,180,056 A * 1/1993 Adams et al. ..... 206/256
5,181,650 A * 1/1993 Hollander et al. ..... 206/746
5,197,660 A * 3/1993 Colling ..... 229/120.11
5,419,431 A * 5/1995 Neuber et al. ..... 206/256
6,776,288 B2 8/2004 Kopecky
6,789,726 B2 * 9/2004 Keefe et al. ..... 229/120.011
6,923,365 B2 * 8/2005 Auclair et al. ..... 229/120.011
7,159,717 B2 1/2007 Aldridge
2005/0150788 A1 * 7/2005 Feusner ..... 206/278

OTHER PUBLICATIONS

International Search Report and Written Opinion regarding PCT/US09/02296, dated Nov. 5, 2009.

* cited by examiner

*Primary Examiner* — Jacob K Ackun
(74) *Attorney, Agent, or Firm* — Armstrong Teasdale LLP

(57) ABSTRACT

A package for storing and dispensing a consumable product is provided. The package can be easily constructed from a suitable blank of material and can be composed of first and second compartments hingedly and detachably secured to each other. The package has an initially unopened configuration where the first and second compartments define a substantially common plane. The package is openable from the initially unopened configuration by relative movement of the first and second compartments about the hinge. The package is reconfigurable to either of first and second closed configurations after the initial opening. In the first closed configuration the first and second compartments define a substantially common plane and in the second closed configuration the first and second compartments define spaced apart substantially parallel planes. A blank for a package, a method of making the package and a method of reconfiguring the package are also disclosed.

10 Claims, 20 Drawing Sheets

RECONFIGURABLE PACKAGE FOR CONFECTIONERY PRODUCTS

CROSS-REFERENCE TO RELATED APPLICATIONS

This application is a 35 U.S.C. §371 national stage application of PCT/US2009/002296, filed Apr. 14, 2009, and additionally claims priority to U.S. Provisional Application No. 61/124,054, filed Apr. 14, 2008.

FIELD OF THE INVENTION

The present invention relates generally to product packaging. More particularly, it relates to a reconfigurable package for a product and a method for opening and reconfiguring a package, such as a package for gum or other confectionery products.

BACKGROUND OF THE INVENTION

Packaging of confectionery products and other consumable products is important for marketing and display of the products. It is desirable to present an attractive and distinctive package with space for brand names, graphics and text. Packaging must also serve practical needs such as keeping the products from being damaged during shipping, keeping the products fresh, and in some cases providing a reusable and reclosable container, for example, when not all of the products are likely to be consumed at one time.

Confectionery products such as gum and mints are often packaged in "blister packs" in which individual pieces of the product are contained in separate sealed plastic packs or "blister cavities" spaced on a backing sheet. This type of packaging keeps the products separate, fresh and sanitary and allows sharing one's gum with another person without touching the gum. A consumer removes a product by pressing on the pack and the product contained therein, rupturing the backing sheet and releasing the product.

One or more blister packs are typically placed within a paperboard sleeve to form a package. Desired branding, graphics and other indicia may be printed on the outside of the sleeve. These sleeves are typically open at one or both ends, allowing a consumer to slide a blister pack out of the sleeve for convenient access to the products. However, because of the open ends, the blister pack may fall out during transport or handling of the package. If more than one blister pack is included in the sleeve, once one blister pack has been consumed and discarded, the remaining blister packs may be prone to fall out. Further, since the package may be placed in a consumer's pocket or purse, foreign material such as lint or dirt may enter the open ends of the sleeve. Moreover, such packages are not especially tamper-resistant. For example, an unscrupulous person may slide a blister pack out of a sleeve at a retail display, remove one or more products, slide the blister pack back into the sleeve, and return the package to the display.

It is desirable to provide an improved package for products including, for example, gum and other consumable products, especially those products packaged in blister packs. It is desirable that the package be fully-enclosed for transportation, display and sale, but both easily openable and reclosable by a consumer after purchase.

It is also desirable to provide a package that is convenient for use as a portable package and that may be reconfigured by the consumer into a different and more convenient format, shape or size, so that, for example, the package will fit conveniently in a pocket or purse. Further, it is desirable that the package can be reduced in size after part of the product has been consumed.

It is also desirable to provide an attractive package which in its initial configuration has a relatively large "footprint" for display purposes, to catch the eye of consumers and to provide generous space for branding, graphics, other indicia and textual information. It is further desirable that the package remain neat and attractive after having been opened and reconfigured by the consumer.

Finally, it is desirable to provide a package with an audible sound effect when the package is opened, to add distinctiveness and consumer interest and to signify that a fresh sealed package has been opened.

SUMMARY OF THE INVENTION

In accordance with the present invention, reconfigurable packages are provided for storing and dispensing consumable products, particularly confectionery products such as candy or gum. The package is particularly well-suited for use as a portable package. The portability of the package is enhanced by its ability to be reconfigured. Methods of making the package and methods of reconfiguring the package are also provided in accordance with other aspects of the invention.

In accordance with one aspect of the present invention, a package for storing and dispensing a consumable product is provided. The package is particularly suited for storing confectionery products, such as, for example, chewing gum. The consumable product may be advantageously packaged in a blister pack that is contained within the package. The package can be easily constructed from a suitable blank of material, such as a paperboard blank, for example. In one embodiment, the package for storing and dispensing a consumable product comprises a first compartment sized to receive a quantity of consumable product, a second compartment hingedly and detachably secured to the first compartment, the second compartment sized to receive a quantity of consumable product, the package having an initially unopened configuration where the first and second compartments define a substantially common plane, the package being openable from the initially unopened configuration by relative movement of the first and second compartments about the hinge, the package being reconfigurable to either of first and second closed configurations after the initial opening, where in the first closed configuration the first and second compartments define a substantially common plane and in the second closed configuration the first and second compartments define spaced apart substantially parallel planes. The package may further include at least one severable line of weakening in a side region connecting the first and second compartments in the initially unopened configuration. When the package is initially opened from the unopened configuration, the line of weakening in the side region is separated. The line of weakening can be any suitable line of weakening, including but not limited to a perforated line or a score line. The at least one line of weakening may comprise a second line of weakening on an opposite side of the package.

The package may further include a cover bendably coupled to the first compartment and configured to be releasably engaged to the second compartment. In addition, the cover coupled to the first compartment is configured to releasably engage and close the first compartment after detaching the second compartment from the first compartment. The second compartment can be hingedly and releasably secured to the first compartment by a line of weakening. The line of weakening may be any suitable type of line of weakening, including, for example, score lines and perforations.

In one embodiment, the second compartment includes a slot into which the cover can be releasably engaged. The second compartment may include a slot into which the cover can be releasably engaged after detachment of the second compartment from the first compartment.

In accordance with another aspect of the invention, the line of weakening in the side region is configured to provide an audible indication to a user when that line of weakening is separated upon the initial opening of the package from the initially unopened configuration.

In accordance with another aspect of the invention, adhesive can be provided to permit the cover to be releasably engaged to the first and second compartments. The adhesive may be located on the back of the cover for this purpose. In one embodiment, the initially unopened configuration comprises the cover being releasably adhesively secured to the second compartment.

The package may comprise a quantity of consumable product contained in each of the first and second compartments. Any desired type of product can be contained in the first and second compartments. The product may also be contained within a blister pack that is located inside of and can extend between the first and second compartments, which together can define a continuous enclosed volume of the package when in the initially unopened configuration. The blister pack can be composed of two separate blister packages, one located in each of the first and second compartments. Alternatively, a single blister pack can be contained within the first and second compartments that extends between the first and second compartments with a line of weakening parallel to and spaced from the hinge. Thus, when relative movement of the first and second compartments about the hinge opens the package from the initially unopened configuration, the line of weakening of the blister pack is separated or severed. Such separation or severing of the blister pack along its line of weakening may also create an audible indication to a user upon the initial opening of the package from the initially unopened configuration.

In accordance with another aspect of the invention, the package for storing and dispensing a consumable product is provided. The package includes a first compartment sized to receive a quantity of consumable product and a second compartment hingedly secured to the first compartment, the second compartment sized to receive a quantity of consumable product. The package has a closed configuration where the first and second compartments define a substantially common plane. The package is openable from a closed configuration to an open configuration by movement of the second compartment in a direction away from the first compartment along the common plane followed by relative movement of the first and second compartments about the hinge. In the fully open configuration, the first and second compartments define spaced apart substantially parallel planes. When the first and second compartments are in the closed configuration, they together define a continuous substantially enclosed volume. The consumable product may be contained in a blister pack in each of the compartments. An overwrapper may be provided to maintain the package in the initially unopened configuration.

In accordance with another aspect of the invention, any of the previously described packages may further include an overwrapper to maintain the package in the initially unopened configuration.

In accordance with another aspect of the invention, a method of reconfiguring a package for storing and dispensing a consumable product is provided. The method includes providing a package, of any of the types previously described. The method further includes initially opening the package from the initially unopened configuration by moving the first and second compartments relative to each other about the hinge and thereafter placing the package into one of the first and second closed configurations. The method may further include initially opening the package by causing the line of weakening in the side region to separate by relative movement of the first and second compartments about the hinge.

In another aspect of the method, the package includes a cover bendably coupled to the first compartment and configured to be releasably engaged to the second compartment to close the package in one of either of the two closed configurations and the method further includes placing the package into one of the first and second configurations by releasably engaging the cover to the second compartment.

In accordance with still another aspect of the method, the cover is coupled to the first compartment and configured to releasably engage and close the first compartment after detaching the second compartment from the first compartment and the method further includes detaching the second compartment from the first compartment and thereafter closing the first compartment by releasably engaging the cover to the first compartment.

In accordance with another aspect of the invention, a blank for making a package is provided. The blank includes a central panel having a first short edge, a first long edge, a second short edge and a second long edge. A top panel extends from the first short edge of the central panel along a score line. A bottom panel extends from the second short edge on the opposite side of the central panel along a score line. A pair of lateral side panels extends in opposite directions from the first and second long edges of the central panel, with each side panel attached to the central panel along a score line, each side panel including and supporting a side flap, each side flap attached to a side panel along a score line. A cover flap extends from the top panel along a score line and a back panel extends from the bottom panel along a score line. The central panel has a line of weakening defining a hinge and extending transversely across the front panel from the first long edge to the second long edge and each side panel has a line of weakening extending transversely across the side panel and in alignment with the line of weakening in the central panel.

In accordance with another aspect of the invention, a method of making a package from a blank as previously described is provided. The method includes longitudinally folding opposed longitudinal edges of the blank to form upstanding sidewalls, thereafter transversely folding the lower portion of the blank over and to cover a portion of the upstanding sidewalls to form an initially formed compartment and transversely folding the upper portion of the blank over at least a portion of the upstanding sidewalls not covered by the lower portion to form another compartment in substantially the same plane as the initially formed compartment, with the cover portion of the blank extending over the initially formed compartment.

In accordance with another aspect of the invention, a method of opening a package for storing and dispensing a consumable product is provided. The method includes providing a package comprising a first compartment sized to receive a quantity of a consumable product, a second compartment hingedly secured to the first compartment, the second compartment sized to receive a quantity of consumable product, the package having a closed configuration where the first and second compartments define a substantially common plane. The package is openable from the initially closed configuration to an open configuration by movement of the second compartment away from the first compartment along the common plane in relative movement of the first and second compartments about the hinge, where in a fully open configuration, the first and second compartments define spaced apart substantially parallel planes. The method further includes opening the package from the closed configuration by moving the second compartment away from the first compartment along the common plane and moving the second compartments relative to each other about the hinge. Typically, the moving of the first and second compartments relative to each other about the hinge will occur after the second compartment is moved away from the first compartment along the common plane.

BRIEF DESCRIPTION OF THE FIGURES

FIG. 16 is a perspective view of the blank of FIG. 13A showing the top flaps of the side panels folded in.

DETAILED DESCRIPTION OF THE INVENTION

Figure 1:
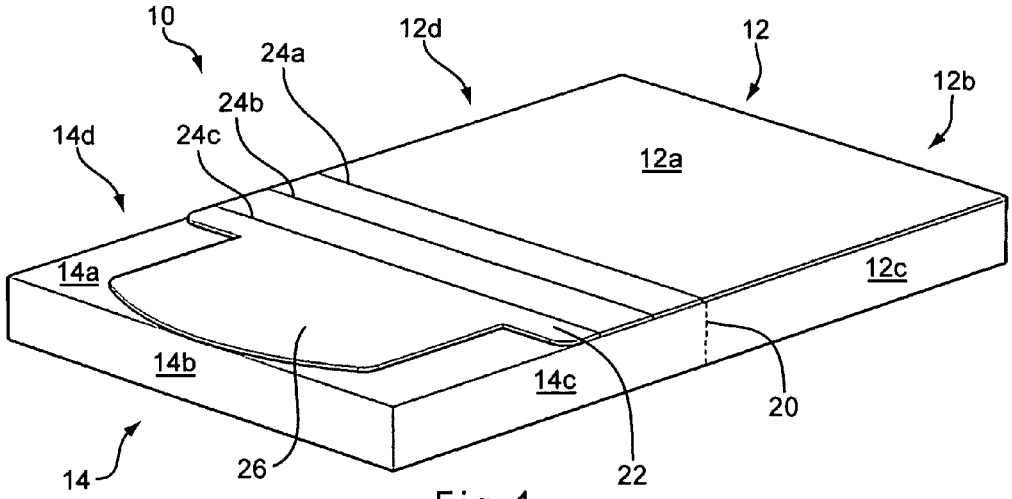
FIG. 1 is a top perspective view of a package in accordance with the invention.
Figure 2:
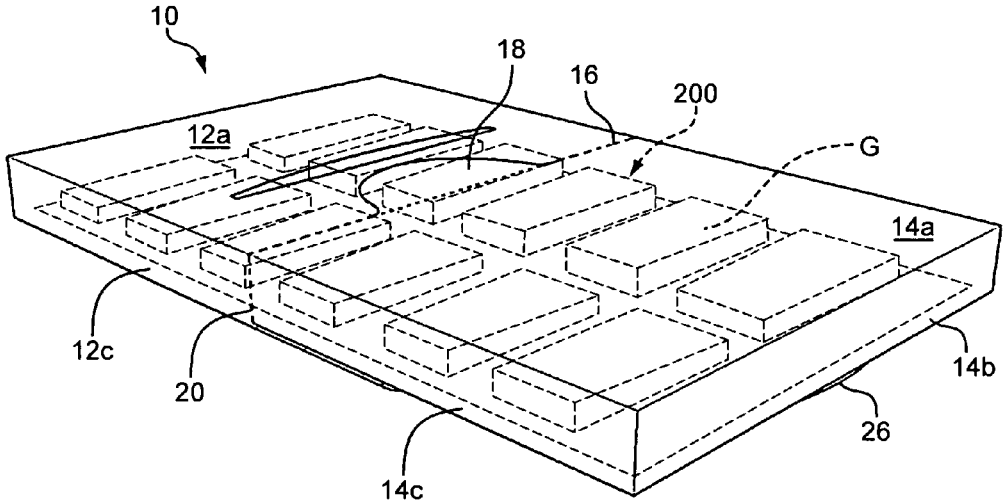
FIG. 2 is a bottom perspective view of the package of FIG. 1.
Figure 3:
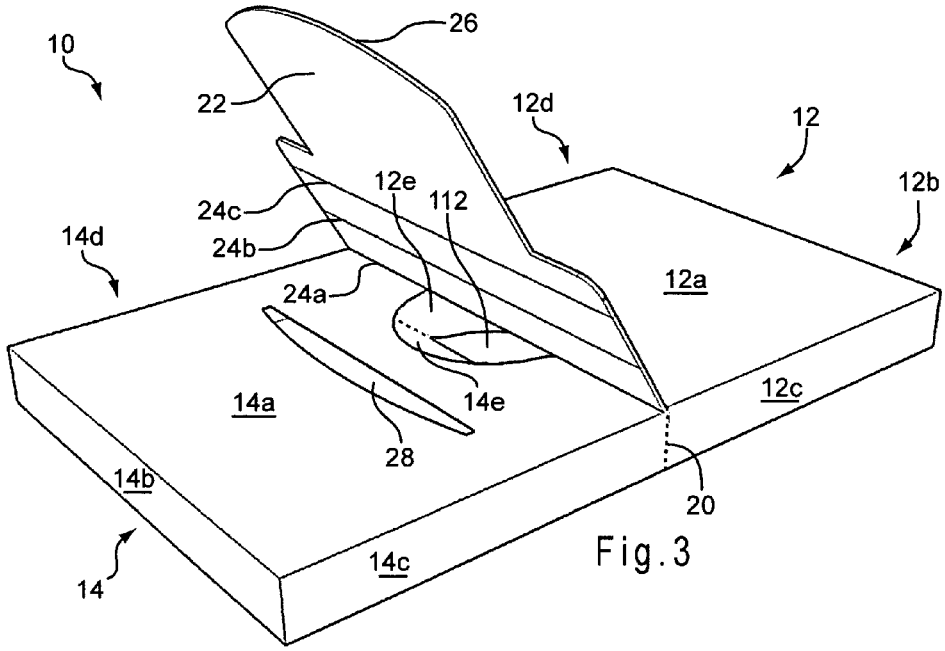
FIG. 3 is a top perspective view of the package of FIG. 1 showing a cover being lifted to begin opening the package.

Referring to the Figures generally and in particular to FIGS. 1-3, perspective views of the package 10 of the present invention are shown in its first, flat configuration, an initially unopened configuration in which the package could be displayed and sold in a retail store, for example. In this embodiment, package 10 is generally rectangular in shape and sized to accommodate, for example, a single layer of pieces of gum contained in one or more blister packs. It will be understood that the shape and size of package 10 may be varied to accommodate different types, sizes and quantities of consumable products. It will also be understood that terms such as "front," "back," "top" and "bottom" are used herein for convenient reference and description, and are not intended to be limiting in any way. For example, the "front" and "back" of package 10 may be interchanged if desired.

Package 10 is divided into a first compartment 12 and a second compartment 14 by a hinge 16 and thumb cut-out 18 and by side panel perforations 20. Package 10 may if desired be enclosed in an outer wrapper or overwrapper such as a clear or opaque plastic film (not shown). In the initially unopened configuration, first compartment 12 and second compartment 14 define a substantially common plane. Compartment 12 includes sides 12*a*-12*e* and compartment 14 includes sides 14*a-e*.

A cover 22 is bendably attached or coupled at one end to first compartment 12 at score line 24*a*. Cover 22 includes additional score lines 24*b-c*. Cover 22 has an extending tab 26. In the initially unopened configuration of package 10, cover 22 lies flat against top side 14*a* of second compartment 14 but is not glued or otherwise affixed thereto. However, cover 22 may optionally be held in place by the outer film wrapper until the outer film wrapper is removed by the consumer so that package 10 can be opened, or alternatively cover 22 may be held in place against top side 14*a* of second compartment 14 by adhesive, for example, which may be in the form of a small bead of glue on the back of cover 22 or on the top of side 14*a* of second compartment 14, for example.

FIG. 2 illustrates a blister pack 200 of gum G as contained in package 10.

Figure 4:
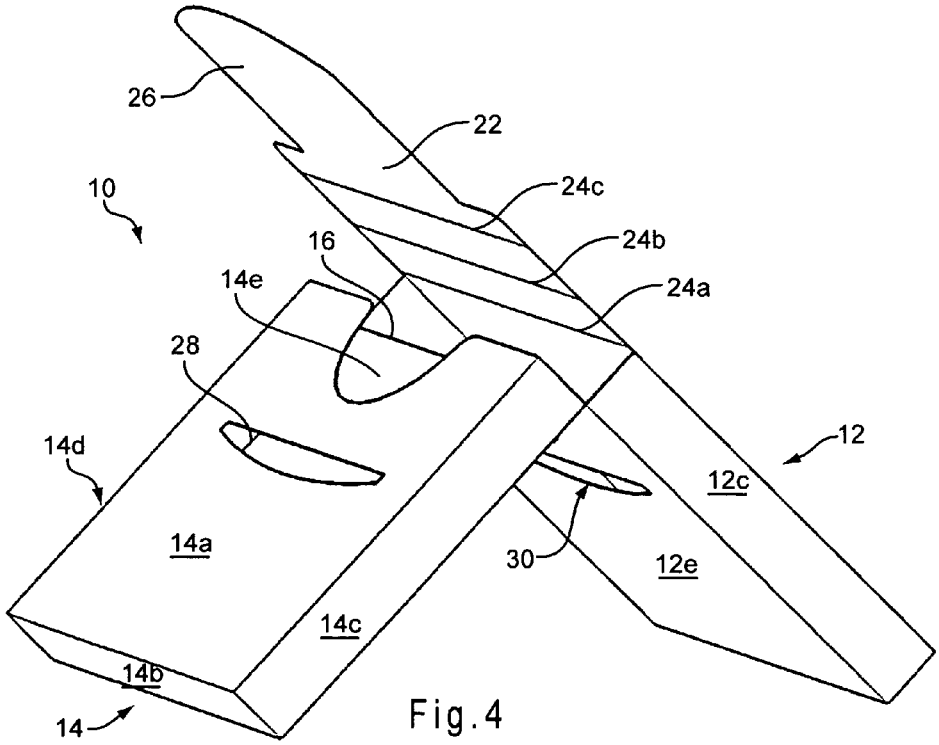
FIG. 4 is a top perspective view of the package of FIG. 1 showing the package being bent along a hinge to open the package.

FIG. 4 illustrates the steps or procedure for initially opening package 10. First, a consumer grasps the ends of compartments 12 and 14 and then relatively moves or rotates first compartment 12 and second compartment 14 with respect to one another along hinge 16 which can be formed by a line of perforations as illustrated in FIG. 2 or alternatively a score line or other line of weakening could be employed. This movement can be continued, for example to approximately the position shown in FIG. 4. The initial opening is most easily done by grasping the ends of package 10 in the fingers of each hand and using the leverage obtained due to the length and relative rigidity of package 10 (the rigidity resulting from the material of package 10 in combination with the material of the blister packs contained in package 10, as will be described below). This movement causes side panel perforations 20 to snap and the package to hingedly open along hinge 16. When side panel perforations 20 snap open, they can emit a "cracking" sound such as when package 10 is constructed of paperboard. When package 10 is thus opened, the blister packs inside are exposed.

A package in accordance with the invention can be reconfigured in any of a number of different configurations as hereafter described. This adds to the ease of portability of a package in accordance with the invention, as the package can be reconfigured to fit in a particular space.

Figure 5:
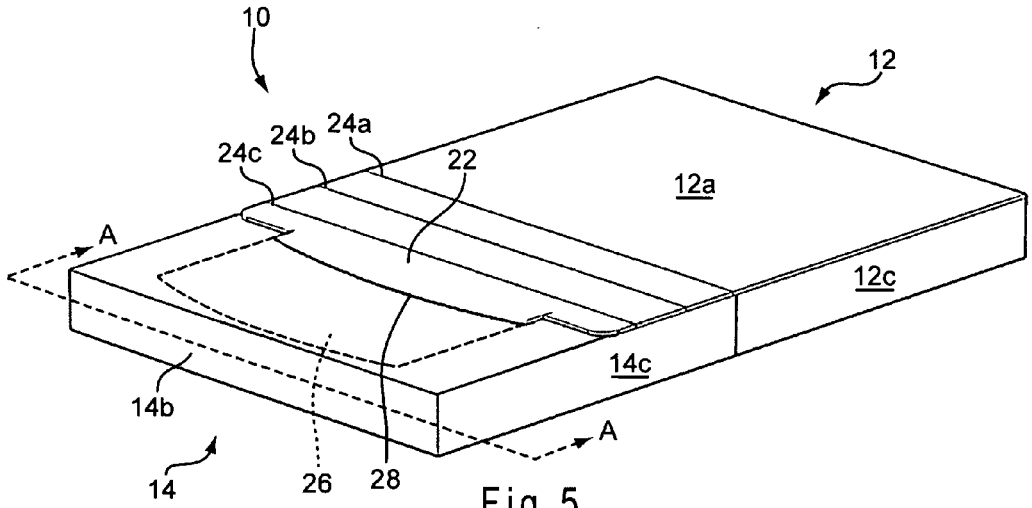
FIG. 5 is a top perspective view of the package of FIG. 1 showing the package reclosed in its original configuration.

FIG. 5 illustrates package 10 reclosed in its closed, flat configuration, that is, where first compartment 12 and second compartment 14 define a substantially common plane as indicated by plane A-A. To close package 10 in this configuration, the consumer returns package 10 to its flat state and inserts tab 26 of cover 22 into receiving slot 28 in second compartment 14. The contents of package 10 are thus again fully enclosed and secure, and package 10 may be placed in a pocket or purse.

Figure 6:
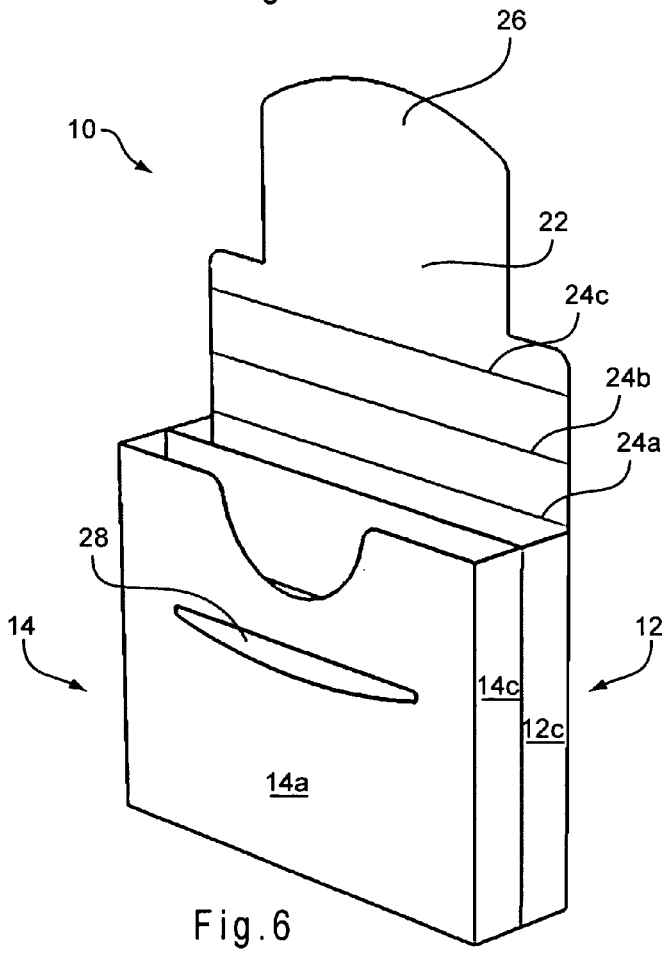
FIG. 6 is a perspective view of the package of FIG. 1 in a second, folded configuration.
Figure 7:
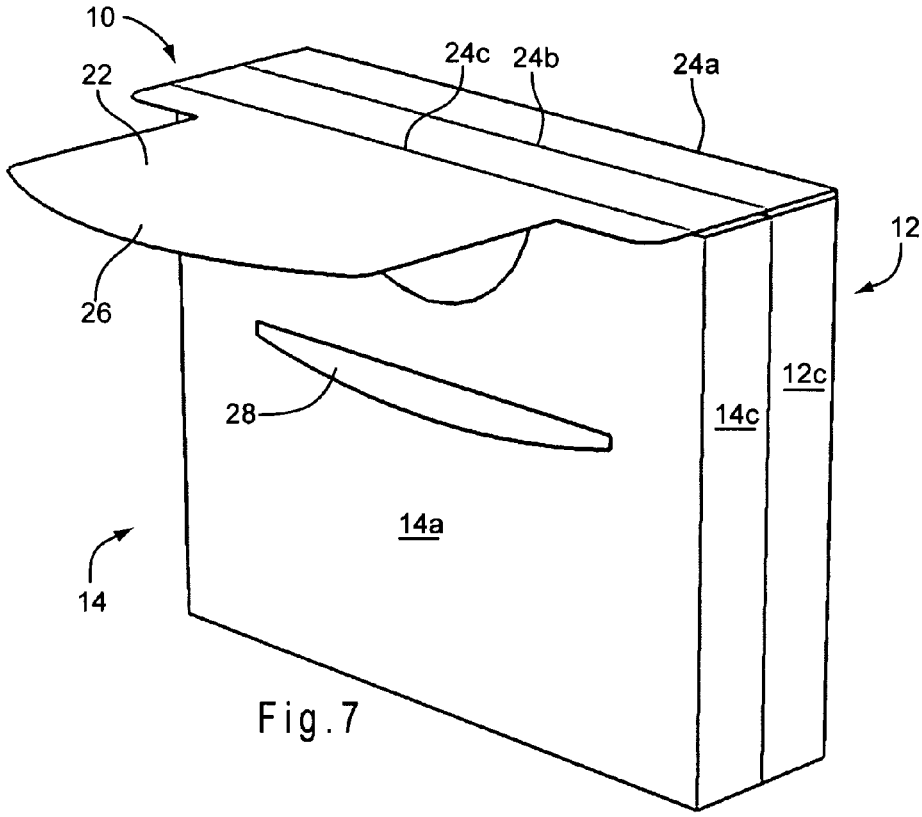
FIG. 7 is a perspective view of the package of FIG. 6 showing the flap/tab being folded over to reclose the package.
Figure 8:
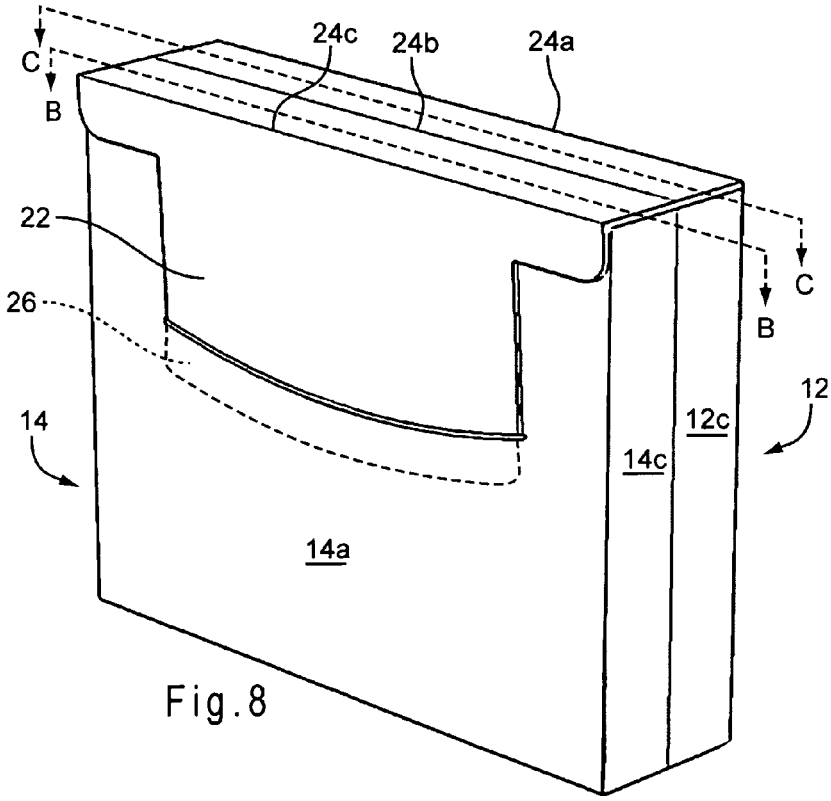
FIG. 8 is a perspective view of the package of FIG. 6 showing the package reclosed in its second, folded configuration.

FIGS. 6-8 illustrate a second, folded configuration of package 10. The consumer folds the two compartments 12, 14 along hinge 16 to a side-by-side position adjacent to one another as shown in FIG. 6. In this configuration, first compartment 12 and second compartment 14 define spaced apart substantially parallel planes B-B and C-C as shown in FIG. 8. To close package 10 in this configuration, a user folds cover 22 along score lines 24*c* over the open ends of both compartments 12, 14 as shown in FIG. 7, and then folds cover 22 down and inserts tab 26 into slot 28 as shown in FIG. 8. Note that the same tab 26 and slot 28 that hold package 10 flat in its flat configuration are used to hold it closed in its folded configuration. In the folded configuration, package 10 is thicker but shorter than in its flat configuration. In the exemplary embodiment shown in which compartments 12 and 14 are of equal size, package 10 in its folded configuration is twice as thick but half as long as in its original flat configuration. With cover 22 in position and held in place by tab 26 in slot 28, package 10 in its folded configuration securely contains gum in both compartments in a smaller (shorter) size overall package. Package 10, once initially opened, when in either of the first or second configurations can be reconfigured back to the other configuration. Thus, reconfiguring between the first and second configurations is not a permanent reconfiguration.

Figure 9:
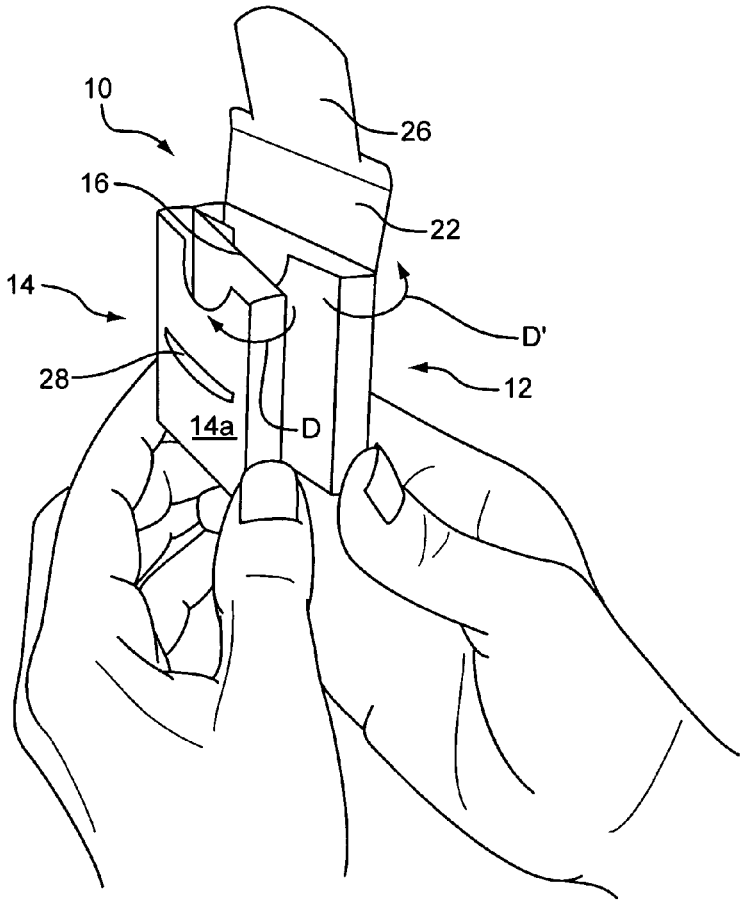
FIG. 9 is a perspective view of the package of FIG. 1 showing the package being separated into two parts by being torn along a perforated line in accordance with the invention.

FIGS. 9-12 illustrate a third, split configuration of package 10. If the consumer wishes to separate package 10 into two smaller packages, or when the gum in second compartment 14 has been consumed, the consumer tears second compartment 14 away from first compartment 12 in the direction of arrows D and D' along hinge 16 and thumb cut-out 18 as shown in FIG. 9.

Figure 10:
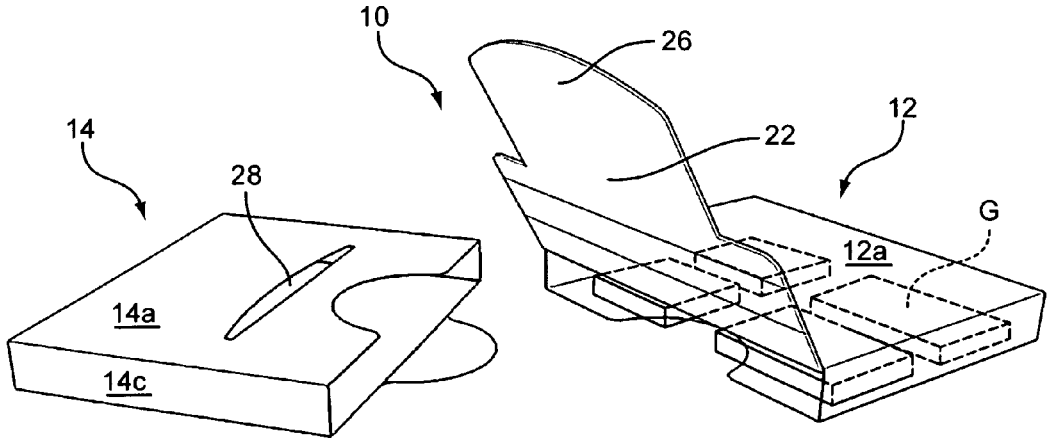
FIG. 10 is a perspective view of the package of FIG. 1 after being separated into two parts.
Figure 11:
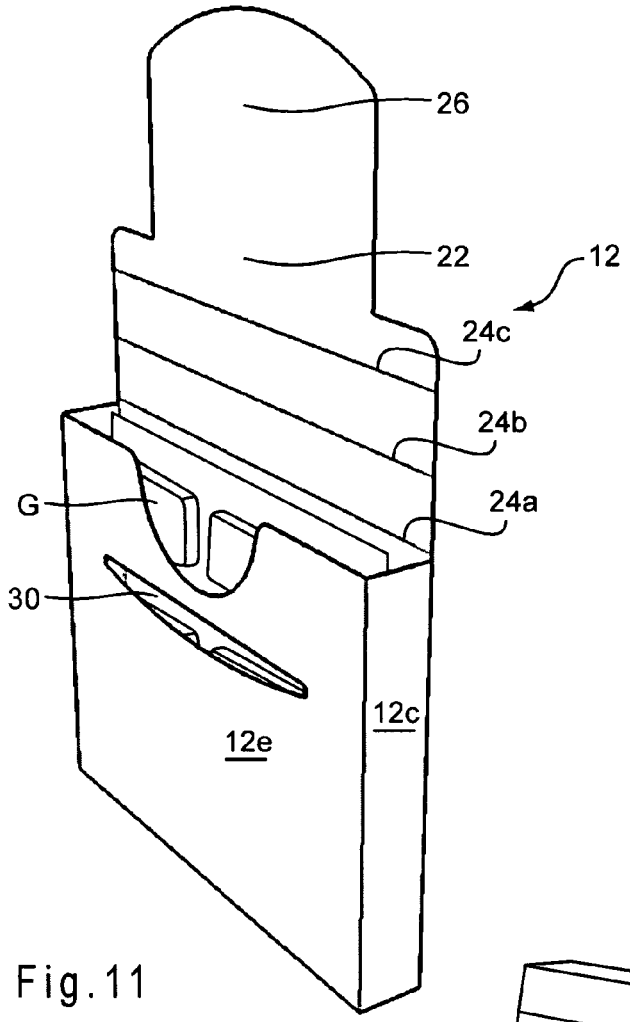
FIG. 11 is a perspective view of one part of the package of FIG. 1 after separation representing the third, single-part configuration of the package.
Figure 12:
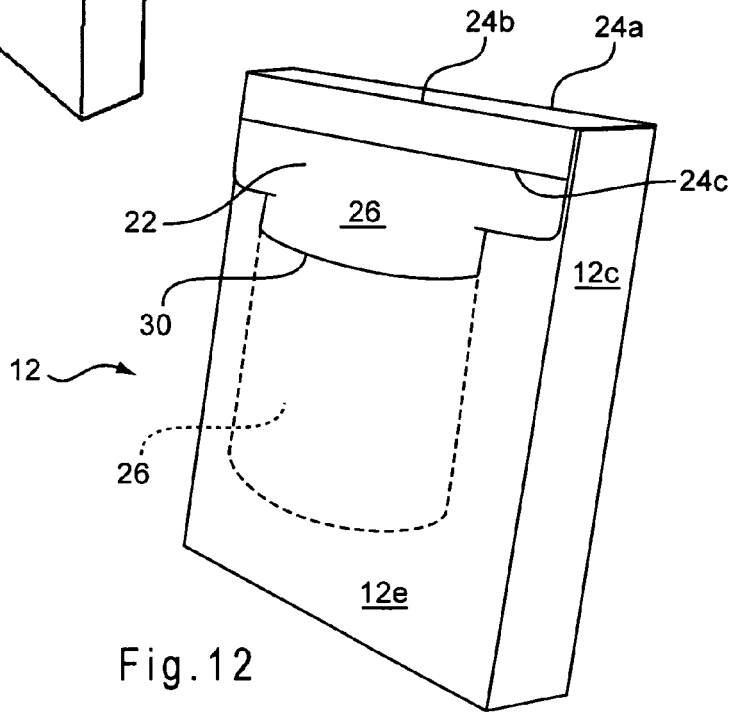
FIG. 12 is a perspective view of the package part of FIG. 11 showing the single part reclosed in its third, single-part configuration.

After the separation, there are now two separate smaller packages as shown in FIG. 10. First compartment 12 containing the remaining gum G may then be closed by folding cover 22 along score lines 24*a* and 24*b* over and inserting tab 26 into slot 30 as shown in FIGS. 11 and 12. With cover 22 in position and held in place by tab 26 in slot 30, package 10 in its split configuration securely contains the remaining gum in a single pack in a smaller size package. Second compartment 14 may be used in its open state if it still contains gum, or may simply be discarded if all of the gum in it has been consumed.

Figure 13A:
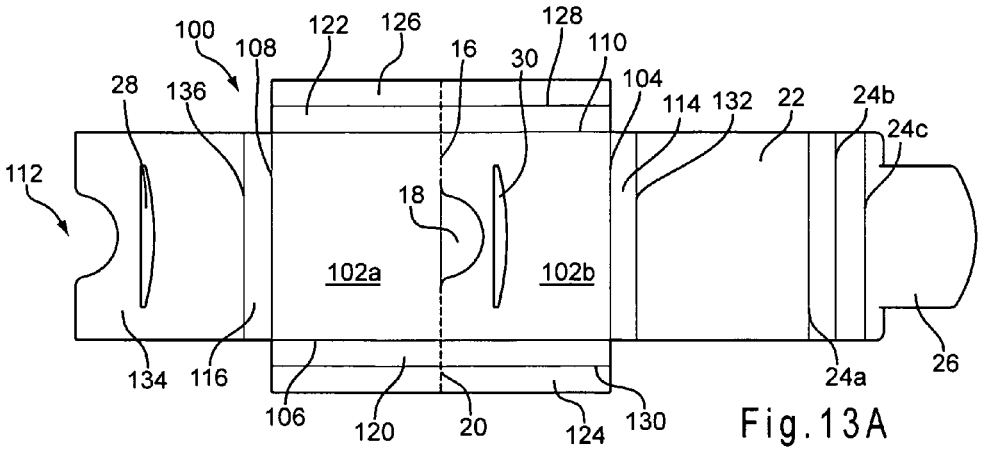
FIG. 13A is a plan view of a blank for the package of FIG. 1.
Figure 14:
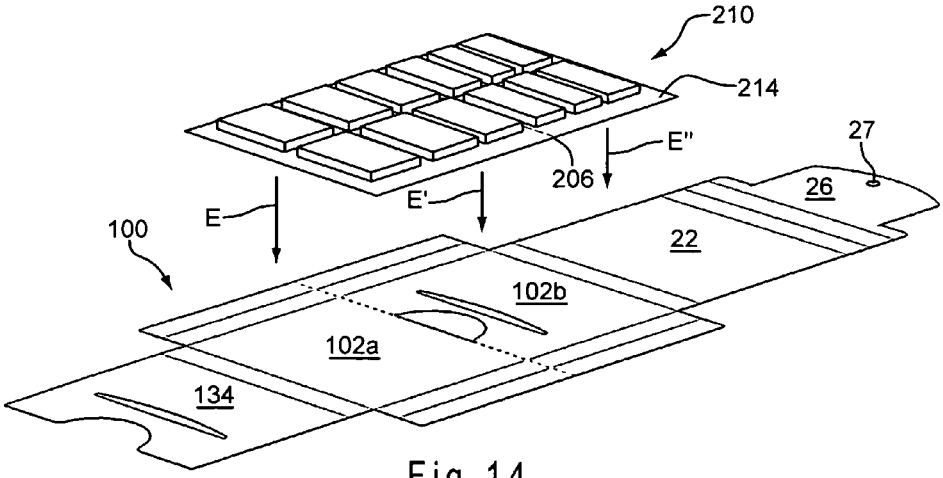
FIG. 14 is a perspective view of the blank of FIG. 13A.

FIGS. 13A and 14 illustrate package 10 in its unfolded, unassembled state. In particular, FIGS. 13A and 14 show a blank 100 that may be folded and glued to form package 10. In alternate embodiments of package 10, the scores, folds and/or perforations may be varied or selected to facilitate removal or detachment of portions or panels of package 10.

Figure 13B:
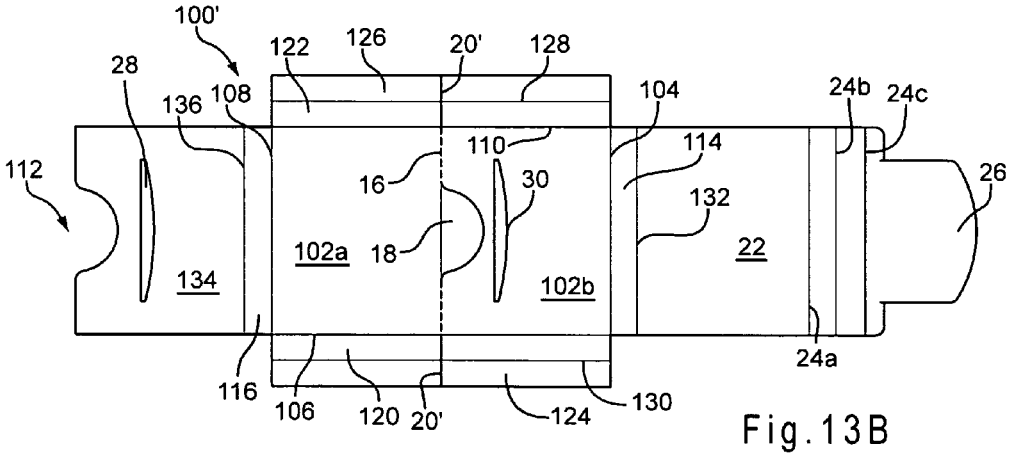
FIG. 13B is an alternate embodiment of FIG. 13A.

FIG. 13B illustrates an alternate embodiment of a package blank 100' in accordance with the invention in an unfolded state. Package blank 100' is the same as package blank 100 except that cuts 20' are substituted for perforations 20 (as used in blank 100).

Blank 100 may be cut, punched or otherwise fashioned from any suitable material such as paper, paperboard, coated paperboard, cardboard, laminate material, polyvinyl chloride (PVC) or other plastic sheets, and the like. The material is preferably relatively inexpensive and may be recyclable. If paperboard is used, it may be solid bleach sulfate (SBS) paperboard which has good folding properties. Indicia such as a product's brand name and graphics may be printed on the side of blank 100 which will form the exterior of the package. The surface of the paperboard which will form the exterior of the package may have a coating such as a white clay emulsion coating to facilitate printing thereon. The interior surface of the package may be uncoated or may be coated, sealed or otherwise treated to prevent contamination, flavor migration, spoilage or other undesirable changes to the consumable products stored in the package. It may also be desirable to reinforce the corners or edges of the assembled package 10 to provide more durability. For example, additional material, glue or heat-activated material may be applied at the corners or edges to seal and otherwise provide the desired reinforcement.

Blank 100 is centered about and extends from the front panels 102*a-b*. Front panels 102*a-b* in this exemplary embodiment form a substantially rectangular panel that includes a first short edge 104, a first long edge 106, a second short edge 108 and a second long edge 110, each edge defining a score line. It will be understood that front panels 102*a-b* may have any shape or geometric configuration and that the naming of the edges is done for convenience and is not meant to be limiting in any way. Front panel 102*b* includes a thumb cut-out 18 and slot 30.

As shown in FIGS. 13A and 14, a top panel 114 extends from first short edge 104 of front panel 102. A bottom panel 116 extends from second short edge 108 on the opposite side of front panel 102. On the lateral sides of front panel 102, a pair of lateral side panels 120 and 122 extend in opposite directions along long edges 106 and 110, respectively. Side panels 120 and 122 include and support side flaps 124 and 126, respectively, which are attached along score lines 130 and 128, respectively.

As also shown in FIG. 13A, cover flap 22 extends from top panel 114 along score line 132. Back panel 134 extends from bottom panel 116 along score line 136. Cover flap 22 includes extending tab 26 and score lines 24*a-c*. Back panel 134 includes an arcuate thumb cut-out 112 and slot 28. Slot 28 in back panel 134 is positioned and adapted to receive tab 26 when package 10 is reclosed in its first, flat and second, folded configurations, while slot 30 in front panel 102*b* is positioned and adapted to receive tab 26 when package 10 is in its third, split configuration.

Hinge 16 extends across the width of front panel 102 and perforated lines 20 extend across side panels 120, 122, including side flaps 124, 126. Hinge 16 meets thumb cut-out 18 as shown in FIG. 13A. Hinge 16 and thumb cut-out 18 define upper and lower front panels 102*a* and 102*b*, respectively. As explained above, hinge 16 in front panel 102 functions as a hinge for both opening package 10 and for folding package 10 into a folded configuration, and also permits the consumer to divide package 10 into two separate compartments by tearing. Perforation lines 20 in side panels 120, 122 break to permit opening package 10 as explained above, and also make the audible cracking sound when package 10 is opened.

Figure 15:
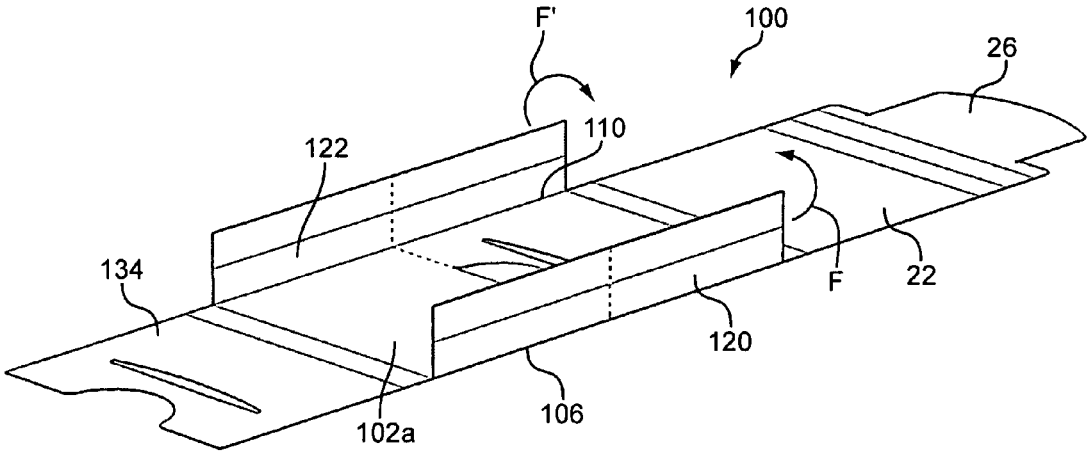
FIG. 15 is a perspective view of the blank of FIG. 13A showing the side panels folded up.
Figure 16:
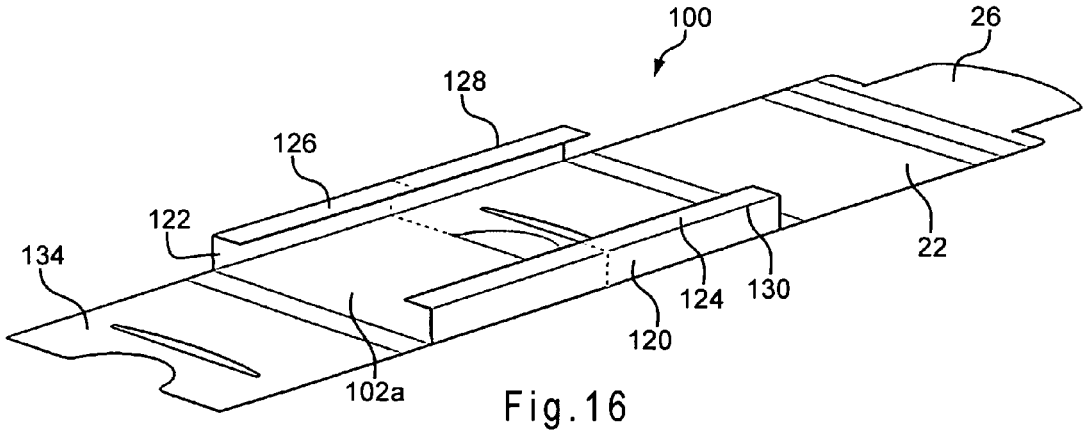
Figure 17:
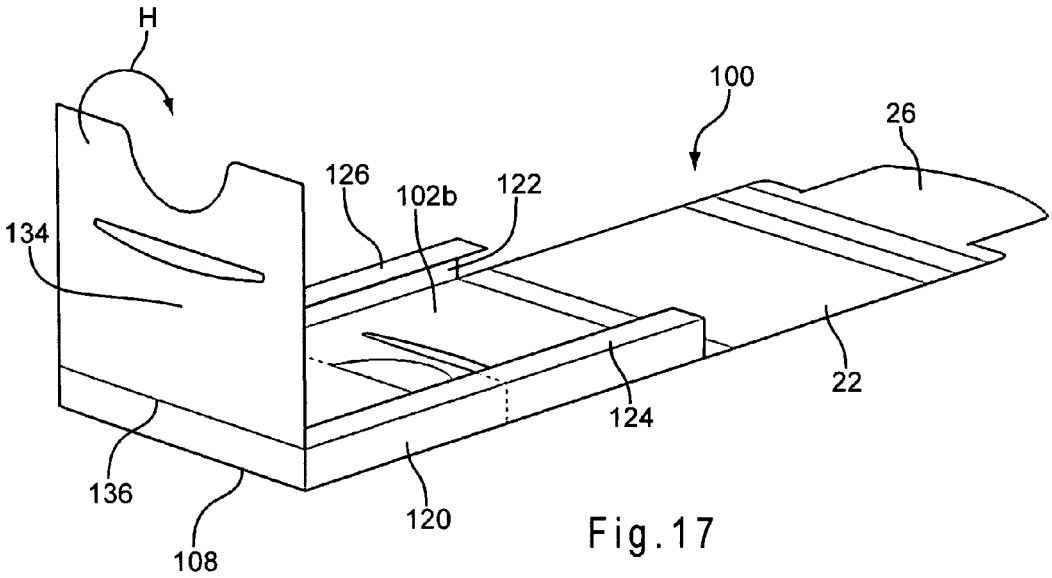
FIG. 17 is a perspective view of the blank of FIG. 13A showing the bottom panel being folded up.
Figure 18:
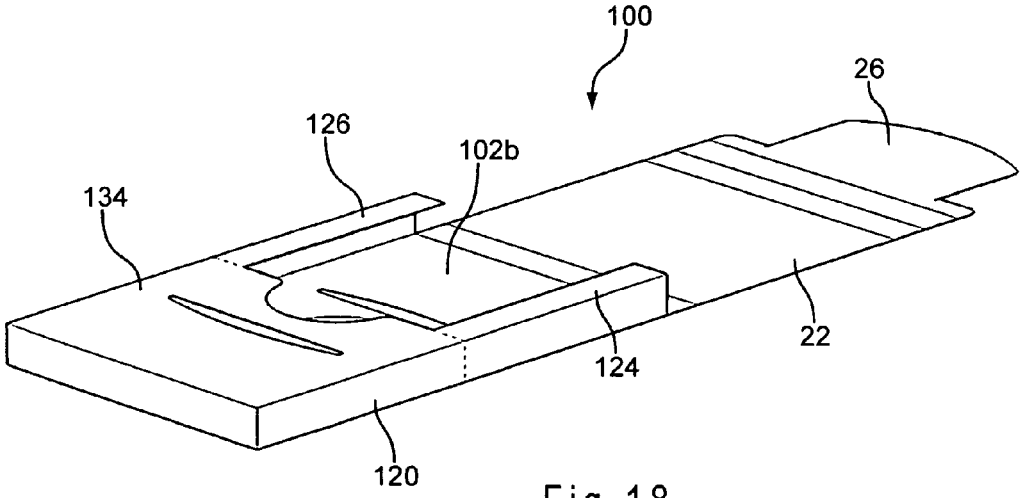
FIG. 18 is a perspective view of the blank of FIG. 13A showing the bottom panel folded over and engaging the top flaps of the side panels.
Figure 19:
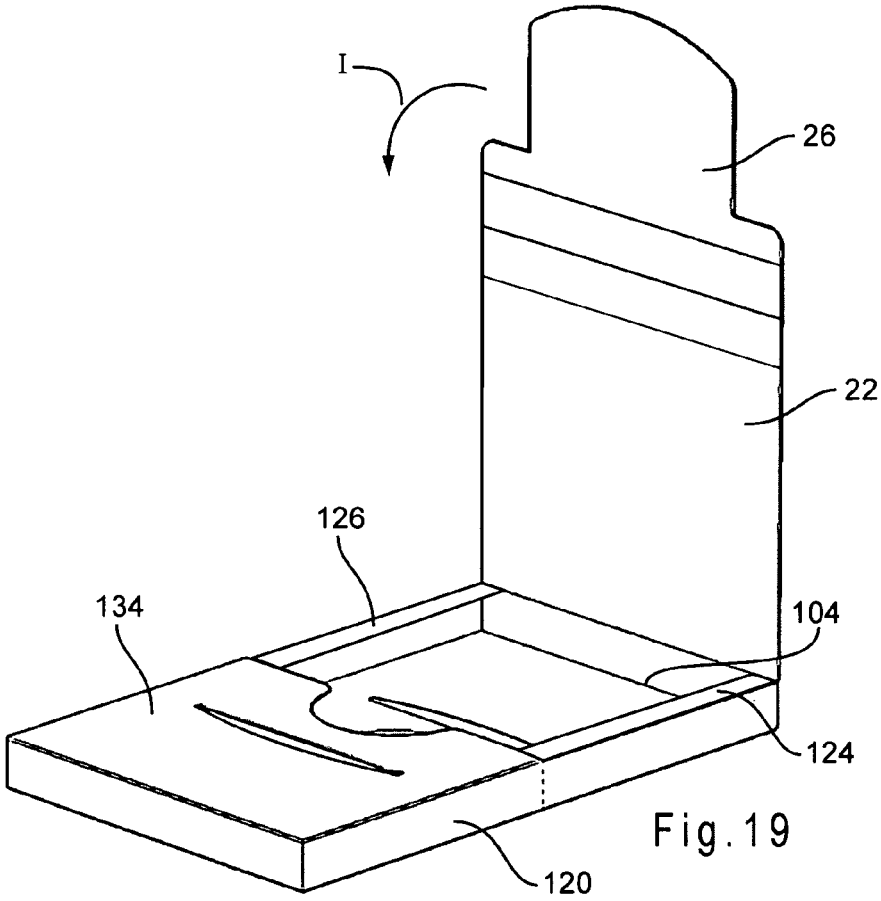
FIG. 19 is a perspective view of the blank of FIG. 13A showing the top panel being folded up.
Figure 20:
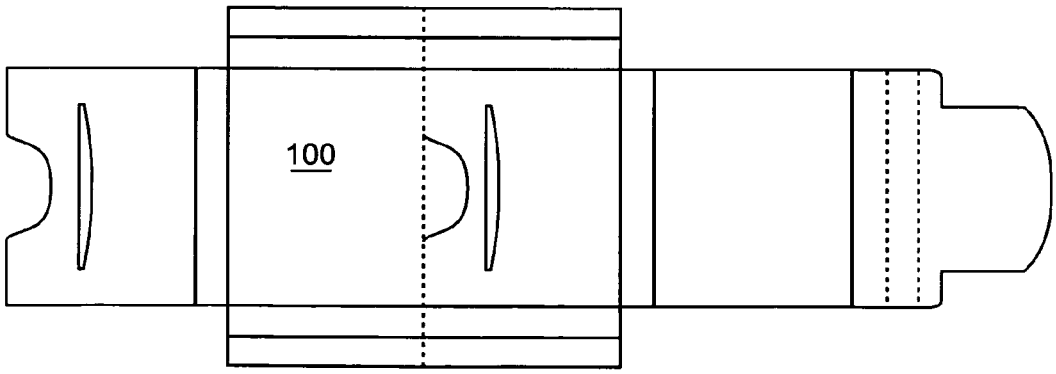
FIG. 20 is a plan view (photograph) of the blank of FIG. 13A.
Figure 21:
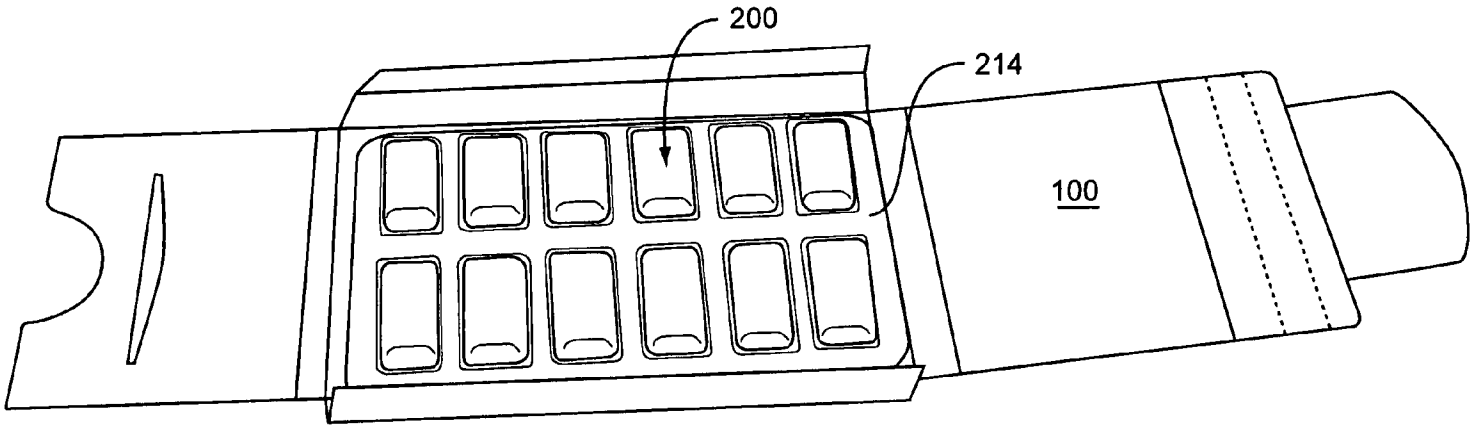
FIG. 21 is a perspective view of the blank of FIG. 20 showing the side panels folded up and product positioned in the package.
Figure 22:
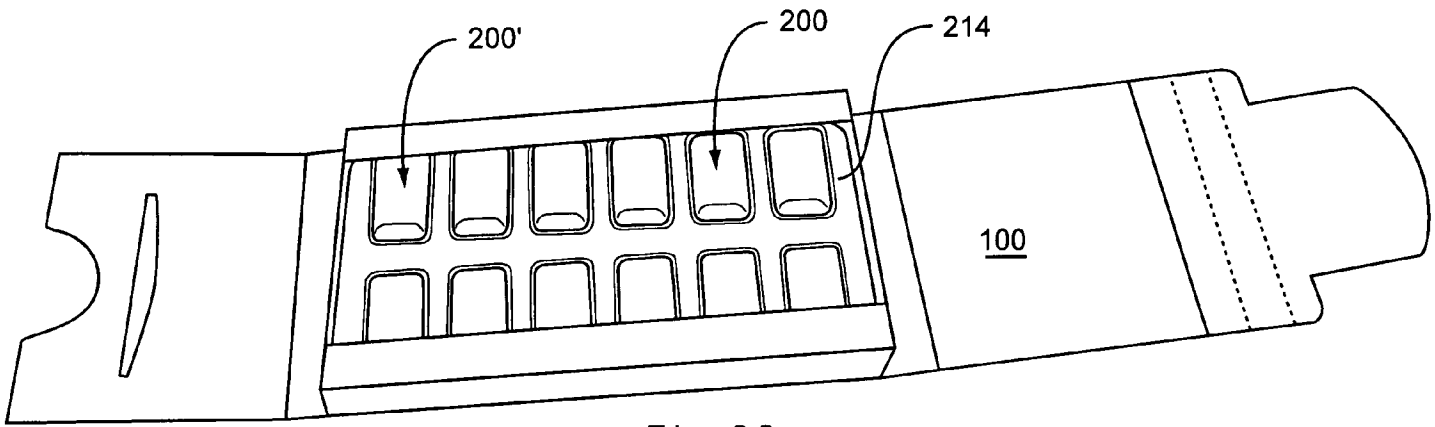
FIG. 22 is a perspective view of the blank of FIG. 20 showing the top flaps of the side panels folded in and product positioned in the package.
Figure 23:
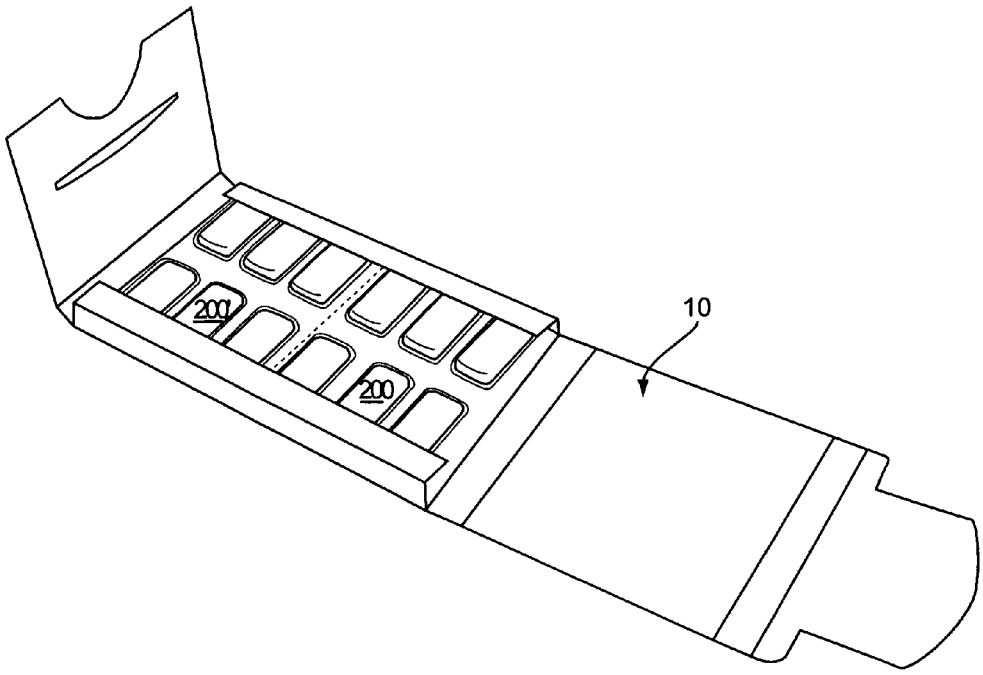
FIG. 23 is a perspective view of the blank of FIG. 20 showing the bottom panel being folded up and product positioned in the package.
Figure 24:
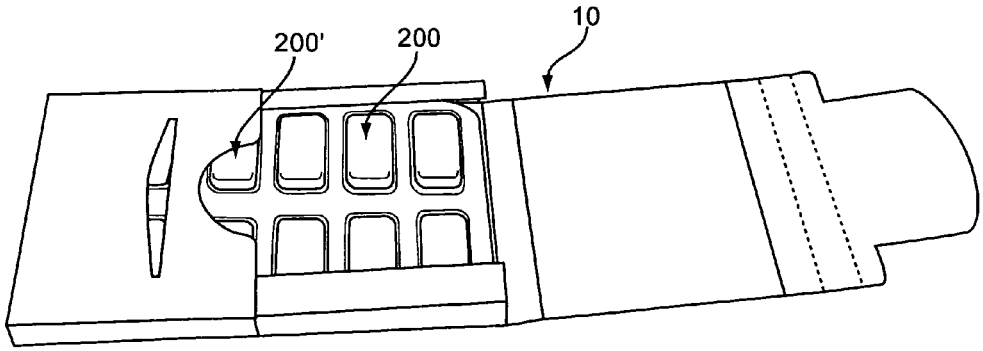
FIG. 24 is a perspective view of the blank of FIG. 20 showing the bottom panel folded over and engaging the top flaps of the side panels.
Figure 25:
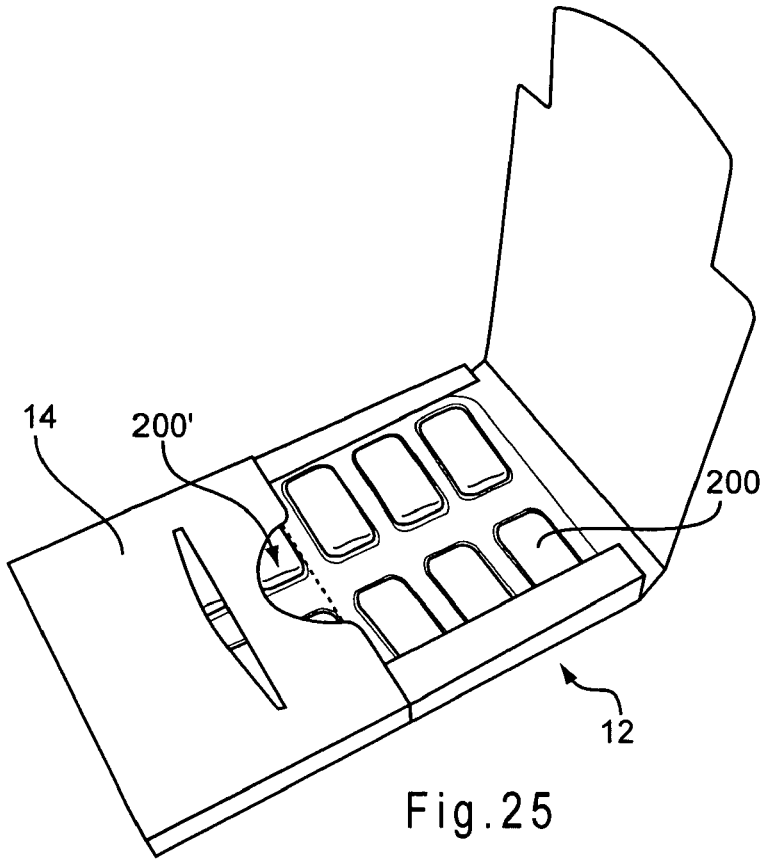
FIG. 25 is a perspective view of the blank of FIG. 20 showing the top panel being folded up.
Figure 26:
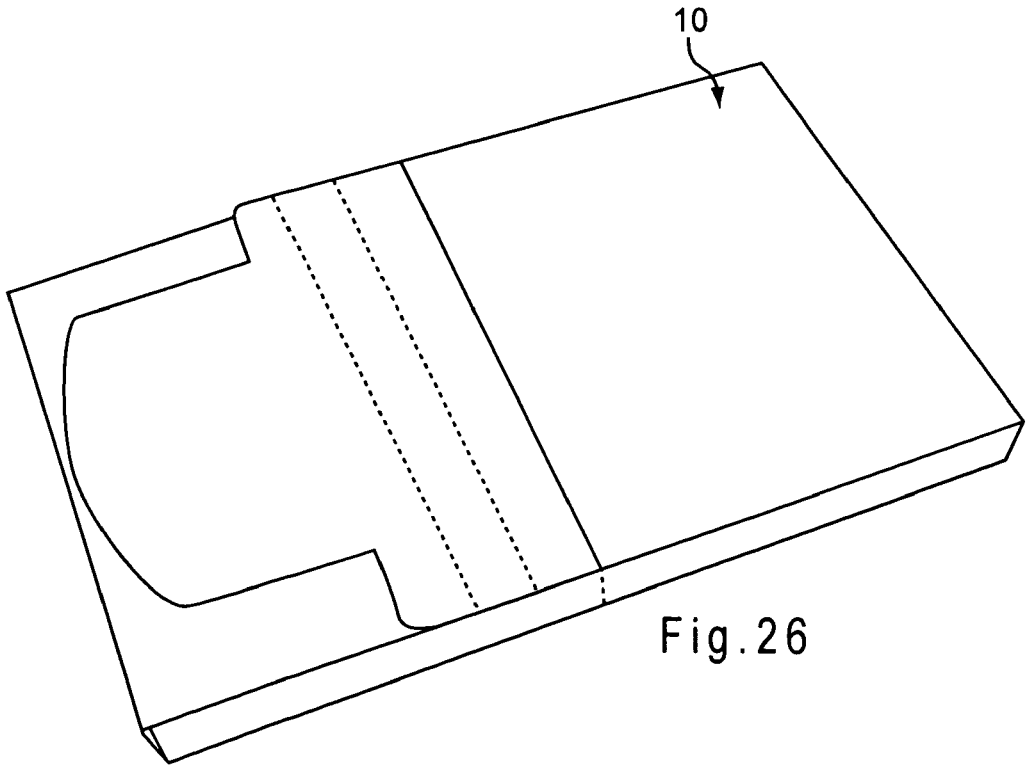
FIG. 26 is a perspective view of the blank of FIG. 20 showing the top panel folded over and forming the assembled package of FIG. 1.

FIGS. 15-19 and 21-26 illustrate the method of assembly of blank 100 into package 10. First, side panels 120 and 122 are bent up along long edges 106 and 110 in the direction of arrows F and F' perpendicular to the plane of front panel 102 (FIG. 15). The product, e.g., blister pack 210 containing gum G is placed on front panel 102 by moving it in the relative direction of arrows E, E' and E", either before or after step 1, as shown in FIGS. 14 and 21. Next, side flaps 124, 126 are bent along scores 128, 130, respectively, so that they are perpendicular to side panels 120, 122 and substantially parallel to front panel 102 (FIGS. 16 and 22). Then, back panel 134 is folded up in the direction of arrow H as shown in FIGS. 17 and 23. Adhesive is applied to the upper surface of side flaps 124, 126. Next, back panel 134 is folded over to engage and be adhered to the upper surfaces of side flaps 124, 126 (FIGS. 18 and 24). Alternately, the adhesive may be applied at the corresponding locations on the surface of back panel 134. A hot melt adhesive or other suitable glue or adhesive may be used. Next, cover 22 is folded up as shown in FIGS. 19 and 25, and then down in the direction of arrow I to engage and be adhered to the upper surfaces of side flaps 124, 126 to form completed package 10 as shown in FIG. 26 with blister packs 200 and 200' (not shown) of gum G (not shown) enclosed therein. Note that the upper portion of cover 22 including tab 26 is not attached to any portion of package 10 by adhesive but remains free, being held in position by the lower portion which is adhered to side flaps 124, 126.

Figure 27:
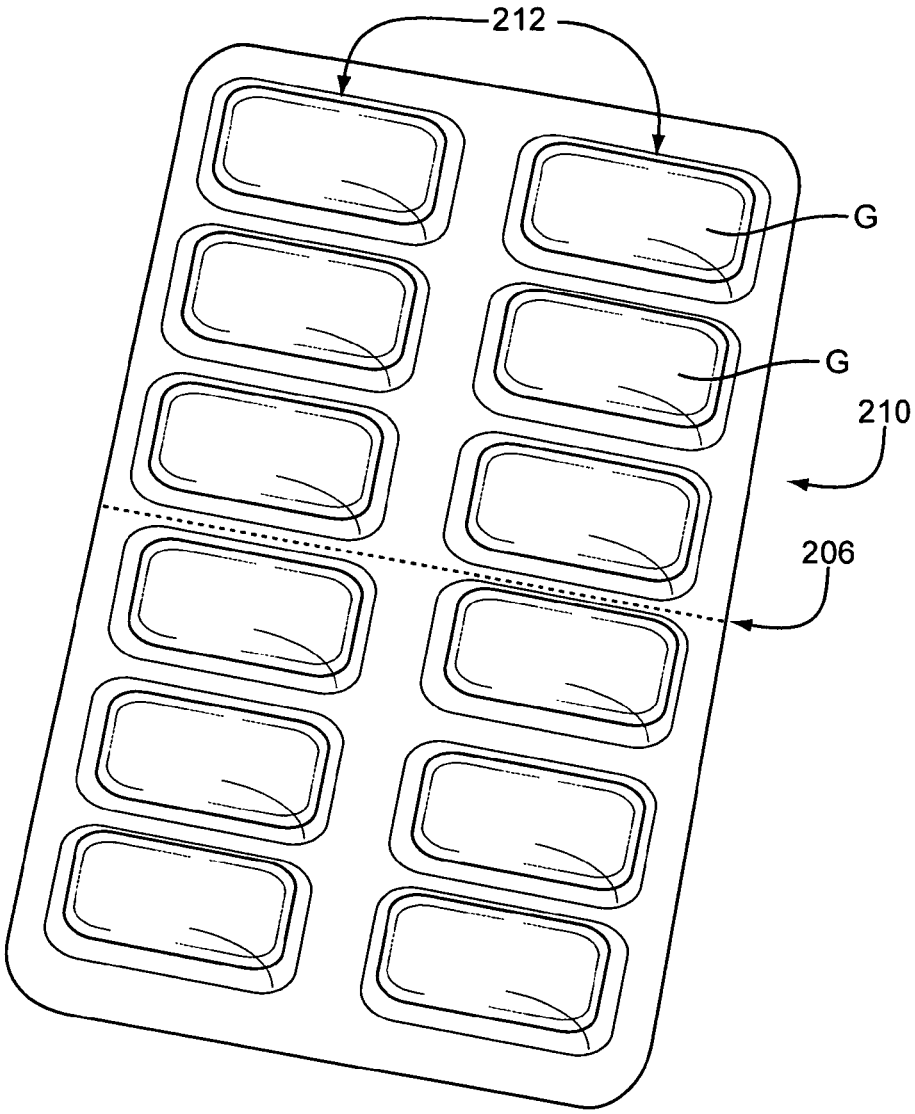
FIG. 27 is a perspective view of a blister pack of gum which may be enclosed in the package of FIG. 1.

The gum or other product may be contained in any desired form, with or without additional packaging. For example, the product may be contained with additional packaging, which can be in the form of one or more blister packs—as shown in FIGS. 21-25. In the embodiment shown, there are two separate blister packs, one sized to fit in each compartment 12, 14. The space between the two blister packs lines up with hinge 16, permitting package 10 to be easily opened from the initially unopened configuration. In an alternate embodiment shown in FIG. 27, the gum is contained in a single blister pack 210 composed of a plurality of blisters 212. A perforated line 206 is provided in the backing sheet 214 of blister pack 210 in a space between the two groups of gum pieces. Backing sheet 214 of blister pack 210 can be any type of material as desired for blister sheet backing material and may be, for example, foil or plastic. When blister pack 210 is placed in package 10, perforation line 206 in blister pack 210 is aligned with but spaced apart from hinge 16 in package 10, which again permits package 10 to be easily opened from the initially unopened configuration since blister pack 210 will also bend and can detach into two blister pack portions along perforation line 206. In addition, the bending and detaching of blister pack 210 can enhance the cracking sound when package 10 is opened. Alternatively, the gum can be contained in the form of individually wrapped sticks or slabs of gum that are then contained in package 10, for example. In addition, the individually wrapped sticks or slabs can be banded together in any convenient manner as desired, such as by a band, sleeve, packet or in any other suitable structure.

In an alternative embodiment, cuts 20' are substituted for perforations in side panels 122, 124 as shown in FIG. 13B. Cuts 20' make it easier to open package 10 since little force is required as compared to the force needed to break perforations 20; however, the audible indication of opening will be either less pronounced or absent. In this alternate embodiment, package 10 may be held closed in its initial unopened state by an outer film wrapper and/or with a glue tack 27 or alternatively by tab 26 being releasably engaged in slot 28 as shown in FIG. 5. If a film wrapper is not used, a glue spot may be provided to releasably attach the underside of cover 22 to the upper surface of second compartment 14.

Figure 28:
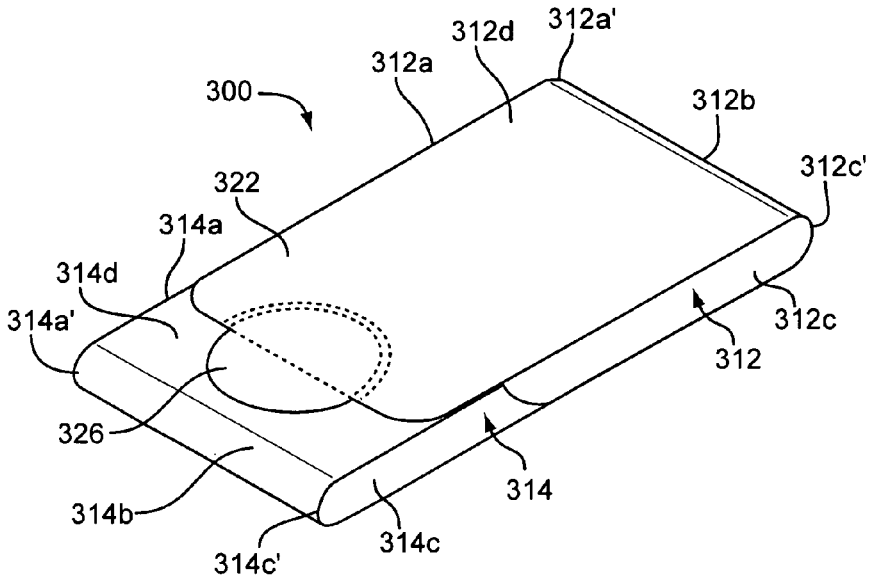
FIG. 28 is a top perspective view of a package in accordance with another embodiment of the invention.

Referring to FIGS. 28-37, alternate embodiments of the invention are illustrated. FIG. 28 illustrates a top perspective view of a package 300 in accordance with the invention. Package 300 is illustrated in FIG. 28 in the initially unopened configuration in which package 300 is flat and could be displayed and sold in a retail store, for example. In this embodiment, package 300 is generally rectangular in shape and sized to accommodate, for example, a plurality of pieces or sticks of gum contained in individual wrappers or in one or more blister packs. It will be understood that the shape and size of package 300 can be varied to accommodate different types, sizes and quantities of consumable products. It will also be understood that terms such as "front," "back," "top" and "bottom" are used herein for convenient reference and description and are not intended to be limiting in any way. For example, the "front" and "back" of package 300 may be interchanged if desired. Package 300 is divided into a first compartment 312 and a second compartment 314 by a hinge 316. Package 300 may, if desired, be enclosed in an outer wrapper or overwrapper such as a clear or opaque plastic film (not shown). In the initially unopened configuration, first compartment 312 and second compartment 314 define a substantially common plane. Compartment 312 includes sides 312*a-e* and compartment 314 includes sides 314*a-e*.

Figure 29:
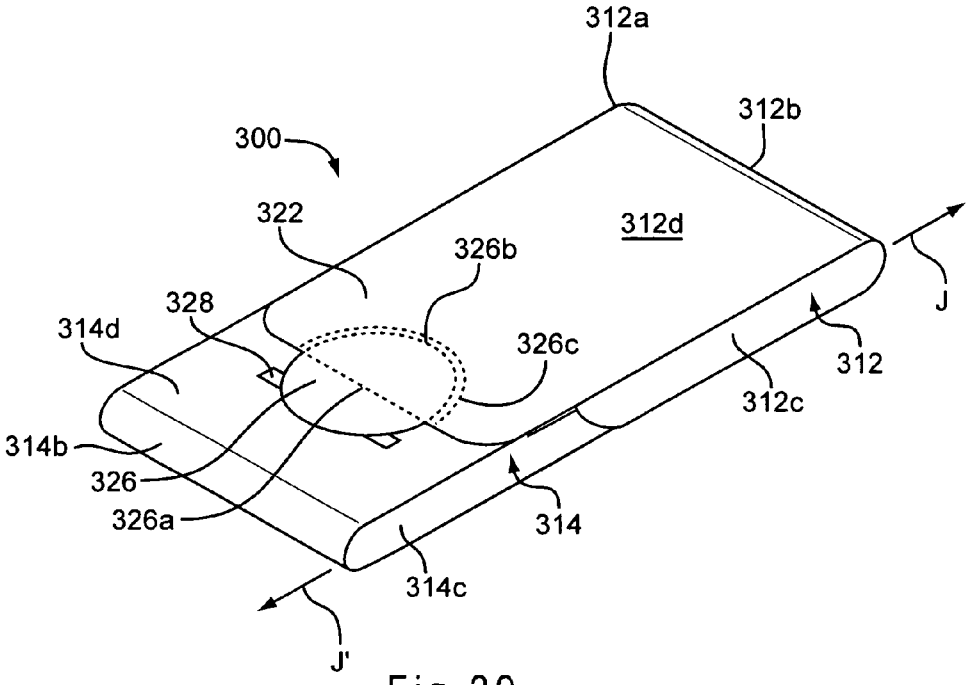
FIG. 29 is a top perspective view of the package of FIG. 28 showing the compartments of the package moved apart.
Figure 30:
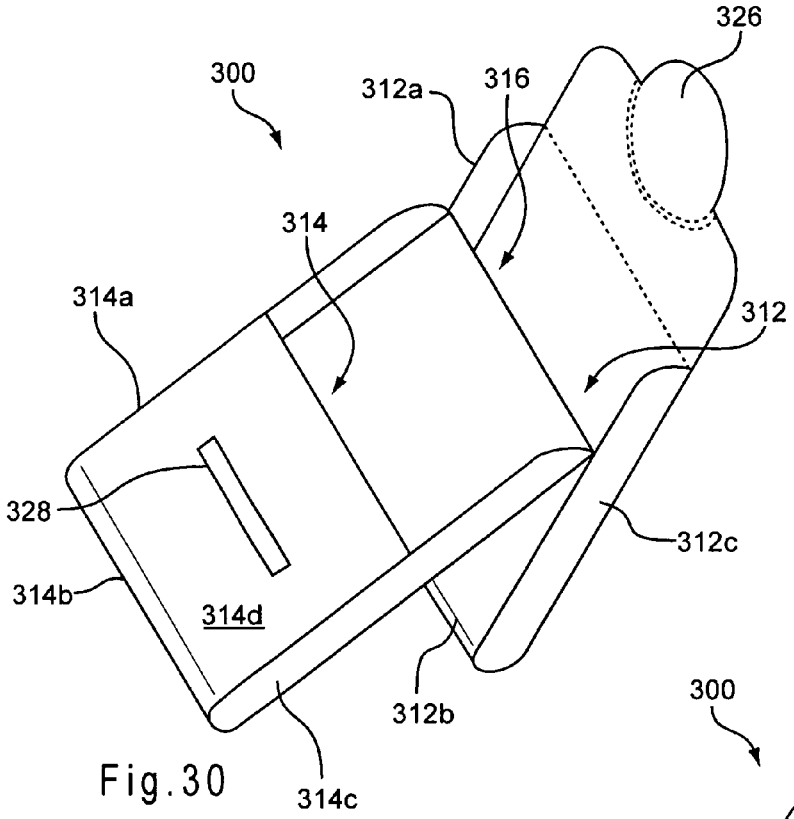
FIG. 30 illustrates the package of FIG. 28 in an open position.
Figure 31:
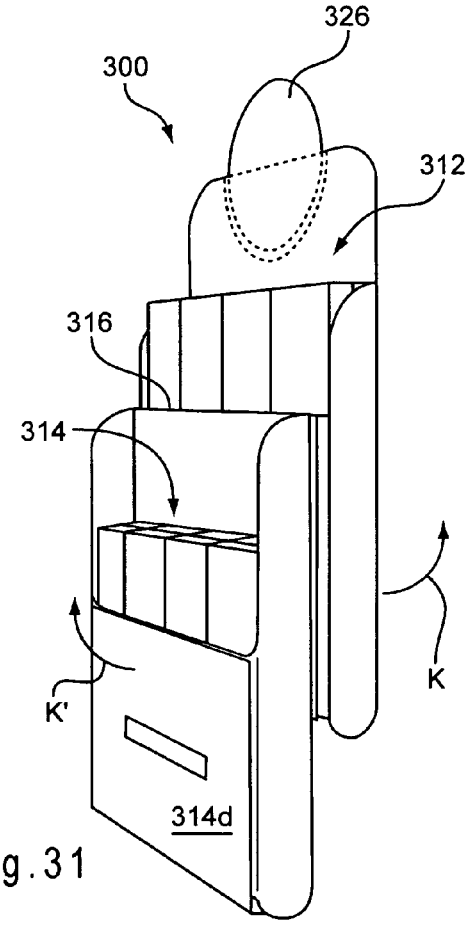
FIG. 31 is a perspective view of the package of FIG. 28 in a fully open position.

A cover 322 is bendably attached or coupled at one end to first compartment 312. Cover 322 includes an extending tab 326 and may also include score lines 326*a-c* which can facilitate bending of extending tab 326 for insertion into slot 328 of side 314*d*. Other score line patterns could be used as desired. In the initially unopened configuration of package 300, cover 322 lies flat against top side 314*d* of second compartment 314, but is typically not glued or otherwise affixed thereto. However, cover 322 may optionally be held in place by an outer film wrapper until the outer film wrapper is removed by the consumer so that package 300 can be opened. Alternatively, cover 322 may be held in place against top side 314*d* of second compartment 314 by adhesive, for example, which may be in the form of a small bead of glue on the back of cover 322 or on the top of side 314*d* of second compartment 314, for example. FIGS. 29-31 illustrate the steps or procedure for initially opening package 300. It is to be understood that the same steps or procedure can be utilized for opening package 300 after it has been reclosed after the initial opening. First, a consumer grasps the sides of compartments 312 and 314 and then relatively moves or slides first compartment 312 away from second compartment 314 along the common plane defined by first compartment 312 and second compartment 314 as illustrated by arrows J and J' of FIG. 29. This causes a portion of side 312*d* adjacent side 312*b* in the initially unopened configuration to become part of side 312*b* and in turn a portion of side 312*b* adjacent side 312*e* in the initially unopened configuration is moved to side 312*e* thereby moving hinge 316 from under flap 318 which is secured to flap 320, the combination of which forms a guide for side 312*e*. After hinge 316 is exposed from under flap 318, package 300 can be further opened by relative movement of first compartment 312 and second compartment 314 about hinge 316 as illustrated in FIG. 30. Package 300 can be opened to a fully open configuration by continuing relative movement of first compartment 312 and second compartment 314 about hinge 316 until first compartment 312 and second compartment 314 define spaced apart substantially parallel planes, as illustrated in FIG. 31. Both the partially open position as shown in FIG. 30 and the fully open position of package 300 as illustrated in FIG. 31 provide the consumer access to both first compartment 312 and second compartment 314.

Figure 32:
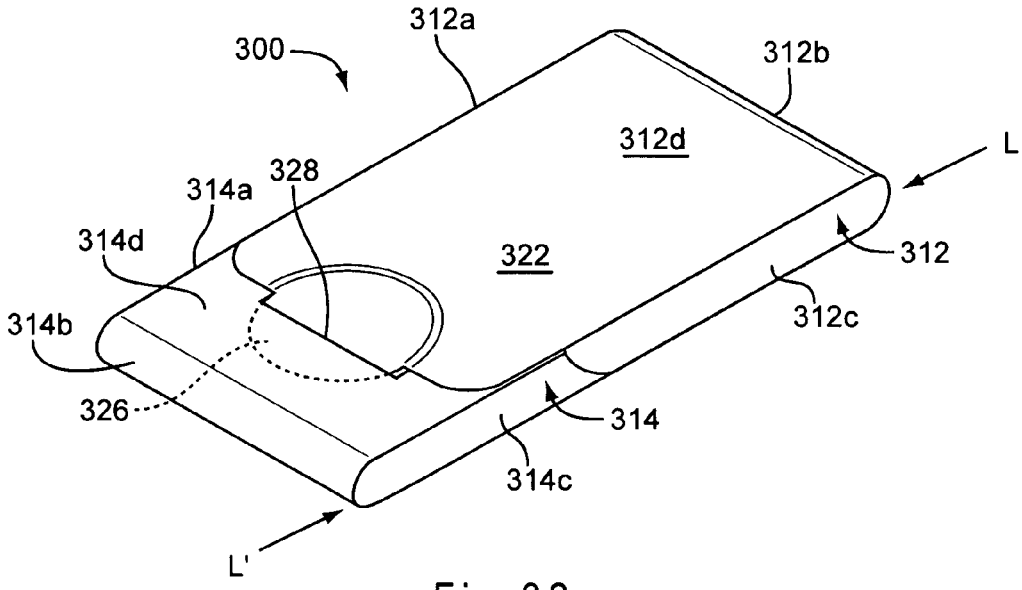
FIG. 32 is a perspective view of the package of FIG. 28 in a reclosed configuration.

Package 300 can be reclosed after opening to a closed flat configuration as illustrated in FIG. 32. This can be conveniently accomplished by relative movement of first compartment 312 and second compartment 314 about hinge 316 in the direction indicated by arrows K and K' in FIG. 31 until first compartment 312 and second compartment 314 are located in a common plane as illustrated in FIG. 29. Thereafter, first compartment 312 and second compartment 314 are moved towards each other in the respective directions of arrows L and L' along the common plane so that first compartment 312 and second compartment 314 are located in the relative original position as illustrated in FIG. 32, with tab 326 of cover 322 having been inserted into slot 328 located in side 314*d*.

It will be appreciated that sides 312*b* and 314*b* of package 300 may be curved as illustrated in FIGS. 28-32. A uniform curve can be facilitated by eliminating score lines in these areas and choosing a material for package 300 that uniformly bends. In addition, sides 312*a*, 312*c*, 314*a* and 314*c* may have curved end portions 312*a*', 312*c*', 314*a*' and 314*c*' that are adjacent respective sides 312*b* and 314*b*. This gives package 300 a novel appearance and can function to enable package 300 to be inserted into a person's pocket, for example, more easily.

In the illustrated embodiment, package 300 is configured to hold sixteen individually wrapped pieces of chewing gum.

Figure 33:
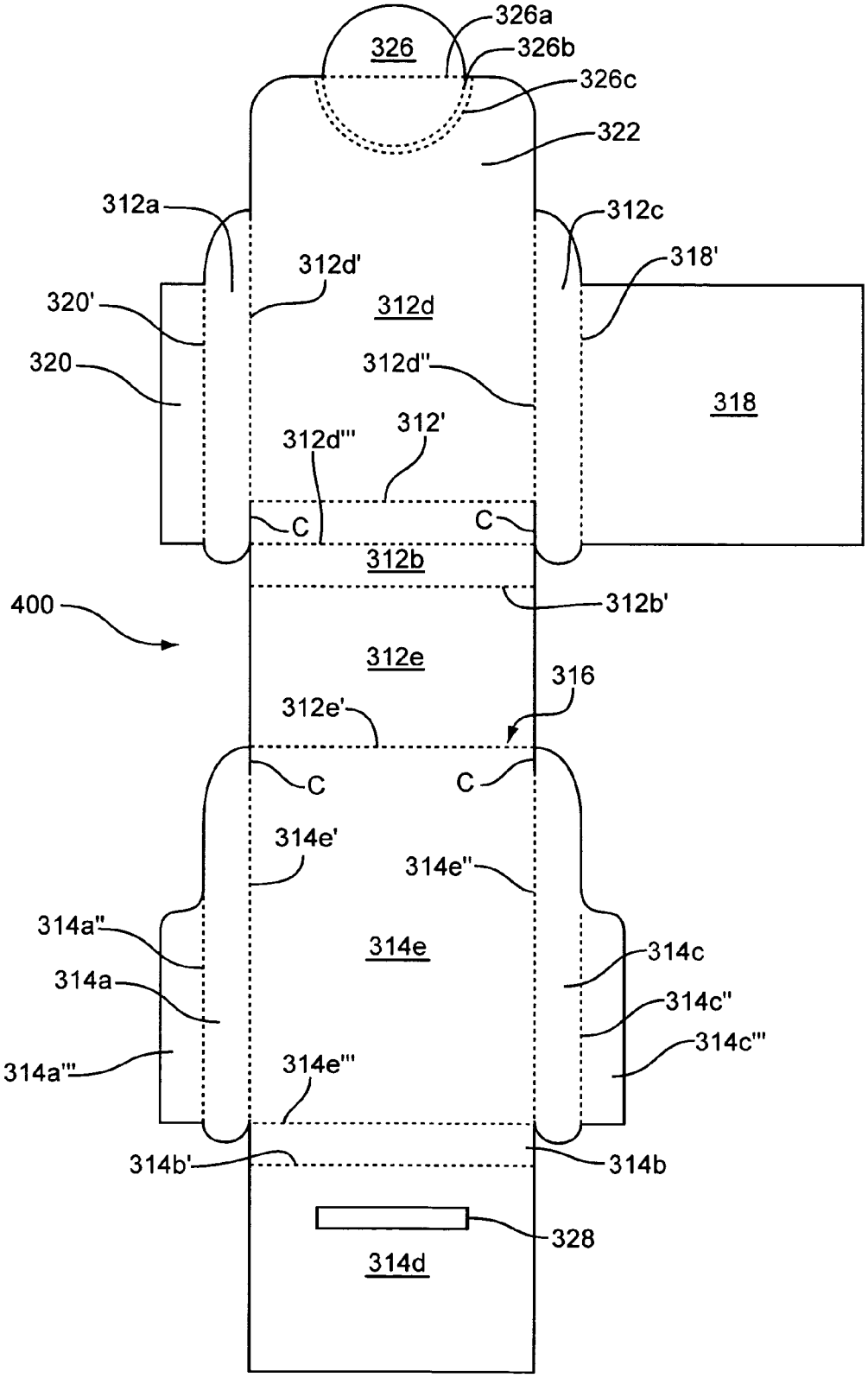
FIG. 33 is a plan view of a blank for the package of FIG. 28.

FIG. 33 illustrates package 300 in its unfolded, unassembled state. More particularly, FIG. 33 illustrates a blank 400 that may be folded and glued or otherwise assembled to form package 300. FIGS. 34-37 illustrate various stages of assembly of blank 400 into package 300.

Blank 400 may be cut, punched or otherwise fashioned from any suitable material, such as that previously described with respect to blank 100. In addition, indicia may be provided on the side of blank 400 and the surface may also have a coating or be uncoated, as well as various reinforcements and additional material, glue or heat activated materials all as described with respect to blank 100. As shown in FIG. 33, tab 326 extends from cover 322 which, in turn, extends from side 312*d*. Sides 312*a* and 312*c* extend from left and right edges of side 312*d*, respectively. Flaps 318 and 320 extend respectively from sides 312*c* and 312*a*. Side 312*b* extends from a lower edge of side 312*d*. Side 312*e* extends from the lower terminal part of side 312*b*. Side 314*e* extends from side 312*e* with hinge 316 extending therebetween. Hinge 316 extends across the width of blank 400. Sides 314*a* and 314*c* extend from respective left and right hand side portions of side 314*e* with flaps 314*a*''' and 314*c*''' extending from the terminal edges of sides 314*a* and 314*c*, respectively.

Various score lines and/or perforations may be provided as desired to facilitate the construction of package 300 from blank 400. For example, the following score lines may be provided. It is to be understood that they may be perforation lines, as desired: score lines 326*a-c*, score line 320' separating side 312*a* from flap 320, score line 318', separating flap 318 from side 312*c*, score line 312*d*''' separating side 312*d* from side 312*b*, score line 312*b*' separating side 312*b* from side 312*e*, score line 312*e*' separating side 314*e* from side 312*e* and forming hinge 316, score line 314*a*'' separating side 314*a* from flap 314*a*''', score line 314*c*'' separating side 314*c* from flap 314*c*''', score line 314*e*''' separating side 314*e* from side 314*b* and score line 314*b*' separating side 314*b* from side 314*d*. Score lines 314*e*' and 314*e*'', respectively separate side 314*e* from sides 314*a* and 314*c*. Score lines 312*d*' and 312*d*'' respectively separate side 312*d* from sides 312*a* and 312*c*. Solid lines located between sides or flaps in blank 400 are cuts such as the solid lines between sides 312*c* and 312*b* and between side 312*a* and side 312*b*. Similarly, the solid lines between side 314*c* and panel 314*e* and between side 314*e* and side 314*a* are cuts, all of which are designated by reference letter C.

Package 300 can be conveniently assembled from blank 400 as illustrated in FIGS. 34-37 and can take place in any order as may be desired or logically implemented by those skilled in the art.

Figure 34:
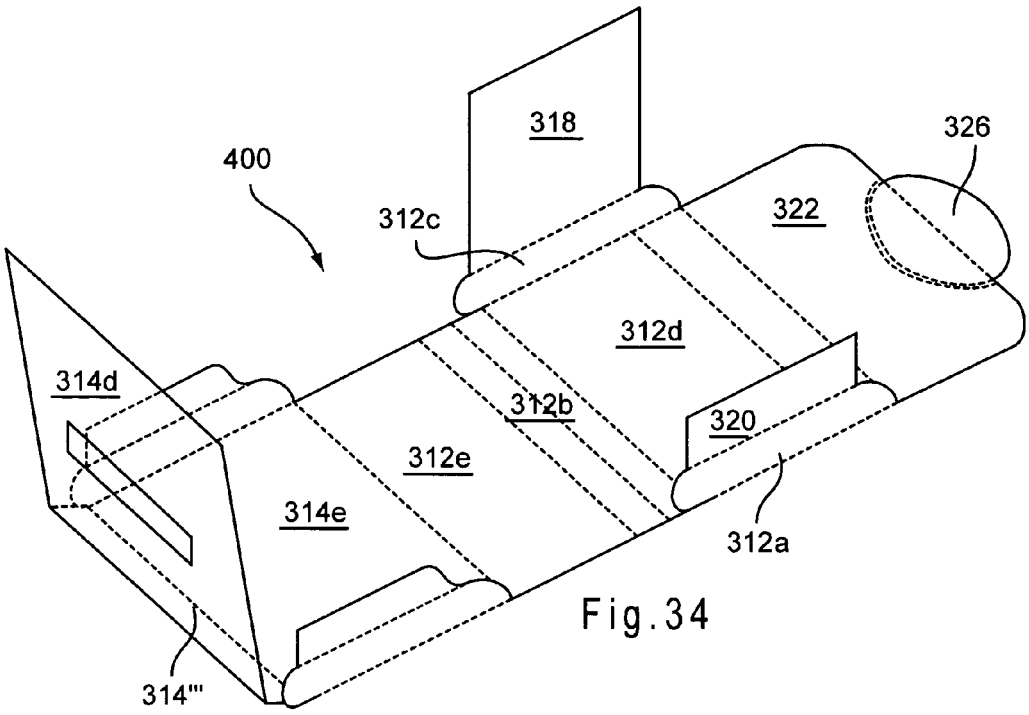
FIG. 34 is a bottom perspective view of the blank of FIG. 33 partly folded up.
Figure 36:
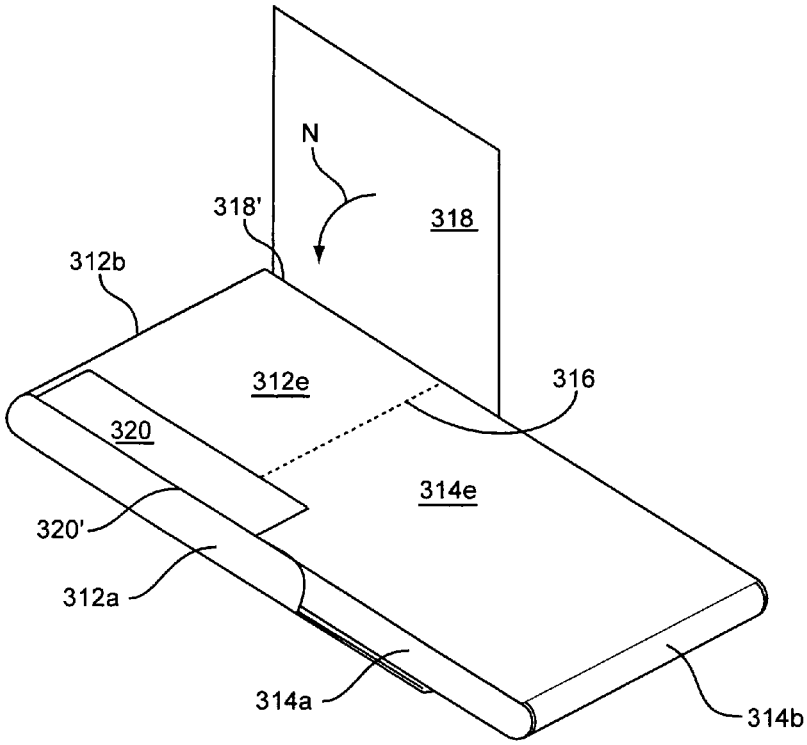
FIG. 36 is a bottom perspective view of the blank of FIG. 33 still further folded up.
Figure 37:
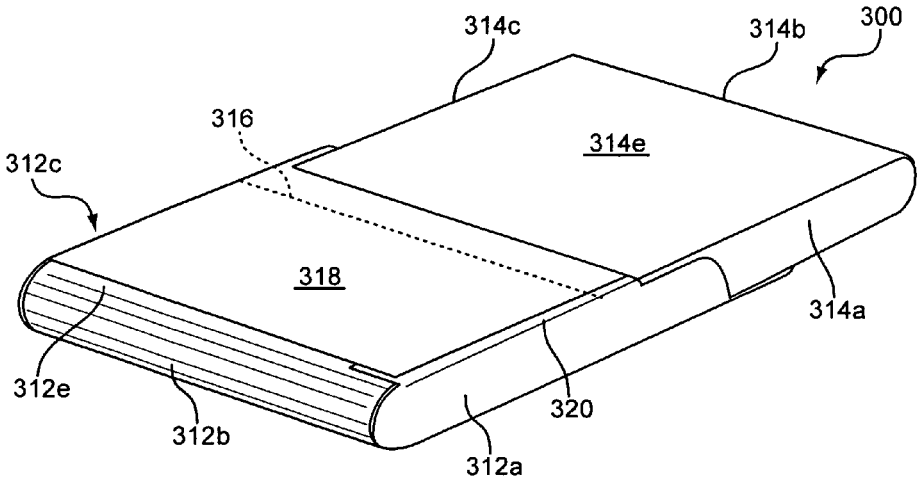
FIG. 37 is a bottom perspective view of the blank of FIG. 33 fully folded up.

Side 312*c* and side 312*a* are folded up along score lines 312*d*'' and 312*d*' as shown in FIG. 34. Sides 314*a* and 314*c* are folded up along score lines 314*e*' and 314*e*'', respectively, and side 314*d* is folded up along score line 314*e*''' (or in its vicinity, if absent) as shown in FIG. 34. Alternatively, score lines 314*e*''' and 314*b*' may be omitted if desired so that side 314*b* can be formed in a smooth, uniform curve as shown in FIGS. 28, 29, 35, 36 and 37 and score lines 312', 312*b*' and 312*d*''' may be omitted if desired so that side 312*b* can be formed in a smooth, uniform curve as shown in FIGS. 28, 36 and 37.

Figure 35:
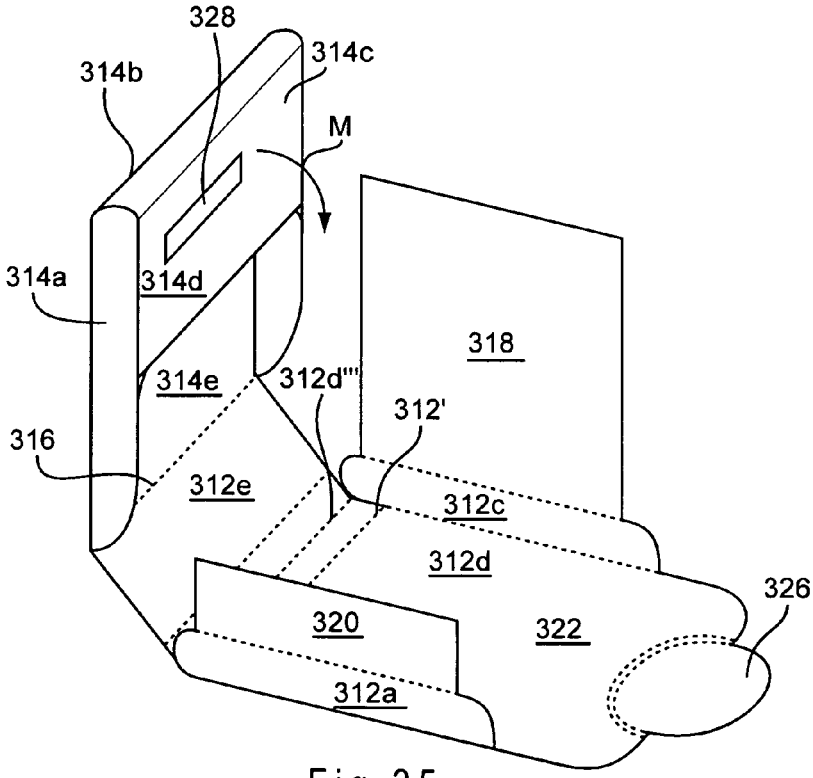
FIG. 35 is a bottom perspective view of the blank of FIG. 33 being further folded up.

Referring to FIG. 35, flaps 314*a*''' and 314*c*''' have been folded over and side 314*d* has been folded on top of those flaps and secured via a suitable adhesive or other securing structure. This results in side 314*d* being parallel to side 314*e* and side 314*a* being parallel to side 314*c*. The product to be contained in compartment 314 can be placed therein before or after formation of compartment 314 by folding side 314*d* onto flaps 314*a*''' and 314*c*'''. Similarly, the product to be contained in compartment 312 can be placed on the interior portion of side 312*d*.

Panel 312*b* is then folded up along score line 312*d*''' (or in its vicinity, if absent), such as by rotating compartment 314 in the direction of arrow M of FIG. 35 until side 314*d* is parallel to and in contact with or substantially in contact with cover 322. This results in the arrangement illustrated in FIG. 36 when the flap 320 is folded along score line 320' so that it is parallel to side 312*e*. Next, flap 318 is folded in the direction of arrow N in FIG. 36 along score line 318' and secured to the top of flap 320 as shown in FIG. 37 such as by a suitable adhesive, for example. Flaps 318 and 320 are not secured to side 312*e*, so that side 312*e* can move with respect to flap 318 and flap 320. Flaps 318 and 320 together with sides 312*a* and 312*c* act as a guide for movement of side 312*e* as compartment 312 is moved away from compartment 314 in a common plane during the initial opening step. It is to be understood that as described with respect to blank 100, any suitable adhesive or manner of securing the panels together as desired can be utilized in accordance with making package 300, such as from blank 400.

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A package for storing and dispensing a consumable product comprising:

a first compartment sized to receive a quantity of consumable product;

a second compartment hingedly secured to the first compartment, the second compartment sized to receive a quantity of consumable product;

a cover bendably coupled to one of the first and second compartments and configured to be releasably engaged to the other of the first and the second compartments;

the package having a first closed configuration where the first and second compartments define a substantially common plane and the cover lays substantially flat along the plane;

the package having a second closed configuration wherein the first and second compartments define spaced apart substantially parallel planes, the cover configured to close the first and the second compartments in the second closed configuration by being bent along the bendable coupling; and the package being openable from the first closed configuration to an open configuration by movement of the second compartment away from the first compartment along the common plane and relative movement of the first and second compartments about the hinge.

2. The package of claim 1 wherein the first and second compartments in the first closed configuration together define a continuous substantially enclosed volume.

3. The package of claim 1 further comprising at least one line of weakening in a side region connecting the first and second compartments.

4. The package of claim 3 wherein the at least one line of weakening comprises a second line of weakening on an opposite side of the package from the at least one line of weakening.

5. The package of claim 1 wherein the second compartment is hingedly and releasably secured to the first compartment by a line of weakening.

6. The package of claim 5 wherein the second compartment comprises a slot into which the cover is releasably engageable.

7. The package of claim 6 wherein the first compartment comprises a slot into which the cover is releasably engageable after when the second compartment is detached from the first compartment.

8. The package of claim 3 wherein the line of weakening in the side region is configured to provide an audible indication to a user when the line of weakening is separated upon the initial opening of the package from the initially unopened configuration.

9. The package of claim 1 comprising an adhesive that releasably engages the cover to at least one of the first and second compartments.

10. The package of claim 1 wherein the initially unopened configuration comprises the cover being releasably secured to the second compartment by an adhesive.

* * * * *